US012534315B2

(12) United States Patent
Okumura

(10) Patent No.: US 12,534,315 B2
(45) Date of Patent: Jan. 27, 2026

(54) MEDIUM CONVEYANCE APPARATUS

(71) Applicant: PFU LIMITED, Kahoku (JP)

(72) Inventor: Hideyuki Okumura, Kahoku (JP)

(73) Assignee: PFU LIMITED, Kahoku (JP)

( * ) Notice: Subject to any disclaimer, the term of this patent is extended or adjusted under 35 U.S.C. 154(b) by 85 days.

(21) Appl. No.: 18/421,633

(22) Filed: Jan. 24, 2024

(65) Prior Publication Data

US 2024/0253919 A1 Aug. 1, 2024

(30) Foreign Application Priority Data

Jan. 31, 2023 (JP) ..... 2023-012921

(51) Int. Cl.
*B65H 1/04* (2006.01)

(52) U.S. Cl.
CPC ..... *B65H 1/04* (2013.01); *B65H 2402/31* (2013.01); *B65H 2402/35* (2013.01);
(Continued)

(58) Field of Classification Search
CPC ..... B65H 2402/30; B65H 2402/31; B65H 2402/35; B65H 2402/45; B65H 2402/46;
(Continued)

(56) References Cited

U.S. PATENT DOCUMENTS 5,586,758 A * 12/1996 Kimura ..... B65H 29/58 271/65
2002/0063374 A1* 5/2002 Takahashi ..... G03G 15/6514 271/10.01

(Continued)

FOREIGN PATENT DOCUMENTS

JP 6586933 B 10/2019
JP 2022-35349 A 3/2022

OTHER PUBLICATIONS

Panasonic KV-S8147 and S8127, https://biz.panasonic.com/jp-ja/productsservices/doc_scanner/lineup/s81x7 (KV-S8147 and S8127 include latches on both sides.) https://panasonic.net/cns/office/products/scanner/kv-s8147_8127/.

*Primary Examiner* — Prasad V Gokhale

(74) *Attorney, Agent, or Firm* — Womble Bond Dickinson (US) LLP

(57) ABSTRACT

A medium conveyance apparatus includes a housing having a frame, a placing table provided on the housing to be openable and closeable and configured to place a medium when the placing table is in an opened state, a to-be-engaged portion provided on the frame, an engagement part provided on at least one side of the placing table to face the to-be-engaged portion when the placing table is in a closed state, a to-be-contacted portion provided on the frame, and a contact portion provided on the placing table. In the medium conveyance apparatus, when the placing table is in the closed state, the engagement part engages with the to-be-engaged portion and maintains the closed state of the placing table. In the medium conveyance apparatus, when the placing table is in the closed state, the contact portion contacts the to-be-contacted portion and restricts movement of the placing table and thereby restricting separation of the engagement part from the to-be-engaged portion.

7 Claims, 15 Drawing Sheets

(52) U.S. Cl.
CPC .. *B65H 2405/115* (2013.01); *B65H 2405/324* (2013.01); *B65H 2405/354* (2013.01); *B65H 2407/21* (2013.01)

(58) Field of Classification Search
CPC ..... B65H 2405/1117; B65H 2405/115; B65H 2405/12; B65H 2405/121; B65H 2405/35; B65H 2405/324; B65H 2405/354; B65H 2407/21
See application file for complete search history.

(56) References Cited

U.S. PATENT DOCUMENTS

| | | | | |
|---|---|---|---|---|
| 2008/0048387 | A1* | 2/2008 | Matsumoto | B65H 31/02 271/207 |
| 2010/0059928 | A1* | 3/2010 | Sugishima | B65H 1/266 271/164 |
| 2015/0130125 | A1* | 5/2015 | Okura | B65H 1/04 271/145 |
| 2015/0344244 | A1* | 12/2015 | Koga | B65H 1/00 271/147 |
| 2018/0057291 | A1 | 3/2018 | Bui | |

* cited by examiner

MEDIUM CONVEYANCE APPARATUS

CROSS-REFERENCE TO RELATED APPLICATION

This patent application is based on and claims priority pursuant to 35 U.S.C. § 119(a) to Japanese Patent Application No. 2023-012921, filed on Jan. 31, 2023, in the Japan Patent Office, the entire disclosure of which is hereby incorporated by reference herein.

BACKGROUND

Technical Field

Embodiments of the present disclosure relate to a medium conveyance apparatus provided with an openable and closable placing table.

Background Art

In a medium conveyance apparatus such as a scanner in which an image of a medium is captured while the medium is being conveyed, an openable and closable placing table on which media are placed may be arranged inside the housing to reduce the size of the apparatus when the apparatus is unused.

A sheet feeder with a manual sheet feeding tray pivotably provided at a recess for accommodation formed on the front cover of the housing is known in the art. In this sheet feeder, the manual sheet feeding tray is pivoted and accommodated in the recess for accommodation when the sheet feeder is not in use. The recess for accommodation has locking portions such as snap-fits on the right and left inner surfaces, and the manual sheet feeding tray has locking holes to be locked by the snap-fits on the right and left side surfaces.

A document feeder having lock mechanisms arranged on both sides in the rotation-axis direction of an openable and closable cover and an opening and closing sensor arranged on one side in the rotation-axis direction of the openable and closable cover is known in the art. The lock mechanism consists of a locking claw arranged on the openable and closable cover and an engaging member arranged on the main frame of the document feeder. The position at which the locking claw touches the engaging member when the lock mechanism is switched from the unlocked state to the locked state is referred to as the first engagement position. The position at which the engaging member touches the locking claw when the lock mechanism is switched from the unlocked state to the locked state is referred to as the second engagement position. The locking claw and the engaging member are arranged such that when the openable and closeable cover is completely closed, the distance between the first engagement position and the second engagement position will be short on the side where the opening and closing sensor is provided, and will be long on the side where the opening and closing sensor is not provided.

SUMMARY

Embodiments of the present disclosure described herein provide a medium conveyance apparatus that includes a housing having a frame, a placing table provided on the housing to be openable and closeable and configured to place a medium when the placing table is in an opened state, a to-be-engaged portion provided on the frame, an engagement part provided on at least one side of the placing table to face the to-be-engaged portion when the placing table is in a closed state, a to-be-contacted portion provided on the frame, and a contact portion provided on the placing table. In the medium conveyance apparatus, when the placing table is in the closed state, the engagement part engages with the to-be-engaged portion and maintains the closed state of the placing table. In the medium conveyance apparatus, when the placing table is in the closed state, the contact portion contacts the to-be-contacted portion and restricts movement of the placing table and thereby restricting separation of the engagement part from the to-be-engaged portion.

BRIEF DESCRIPTION OF THE DRAWINGS

A more complete appreciation of embodiments and the many attendant advantages thereof will be readily obtained as the same becomes better understood by reference to the following detailed description when considered in connection with the accompanying drawings.

Figure 1:
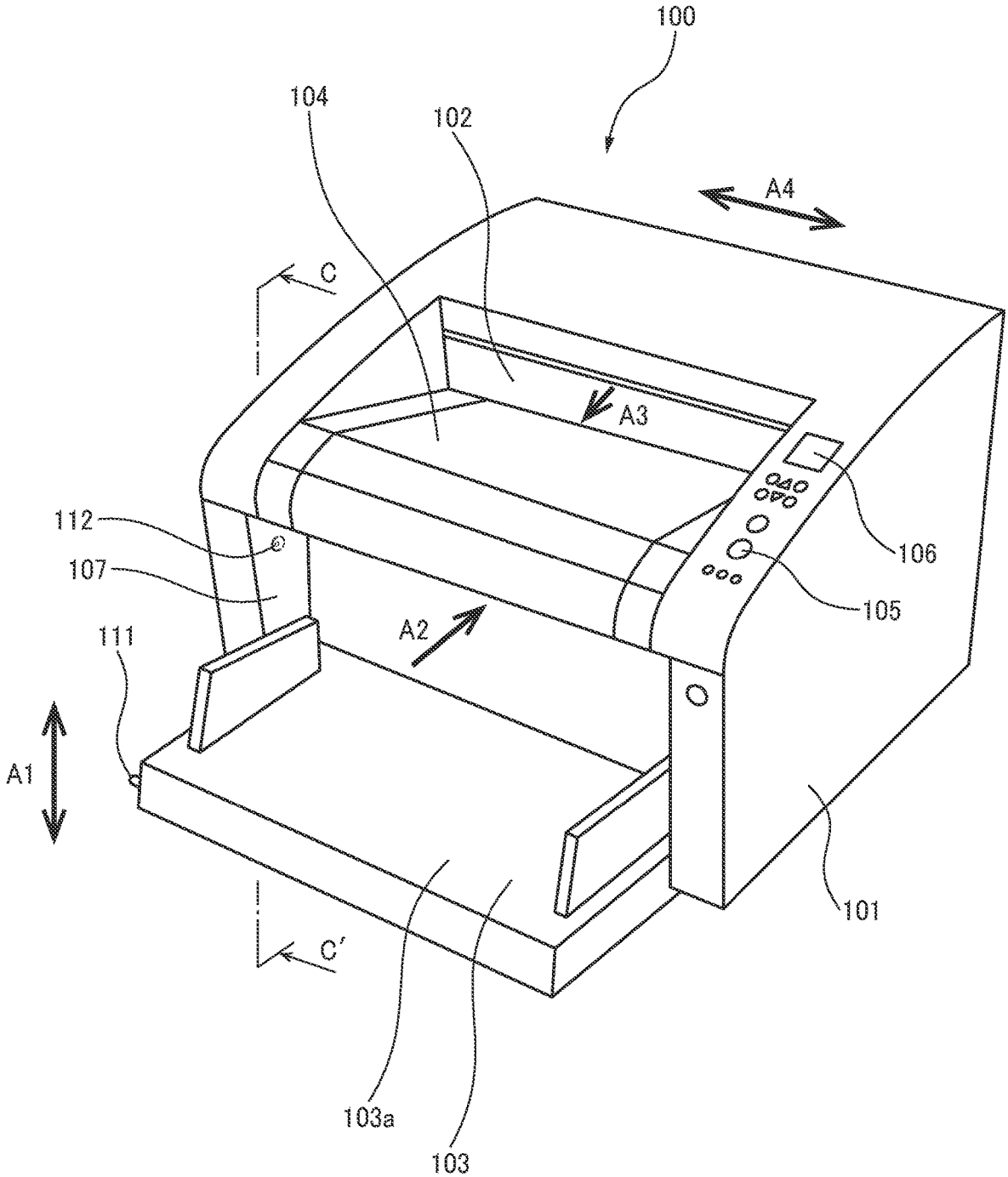
FIG. 1 is a perspective view of a medium conveyance apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to limit the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the present disclosure is not intended to be limited to the specific terminology so selected and it is to be understood that each specific element includes all technical equivalents that have the same structure, operate in a similar manner, and achieve a similar result.

Note that numerous additional modifications and variations are possible in light of the above teachings. It is therefore to be understood that within the scope of the appended claims, the embodiments of the present disclosure may be practiced otherwise than as specifically described herein. For example, elements and/or features of different illustrative embodiments may be combined with each other and/or substituted for each other within the scope of this disclosure and appended claims.

A medium conveyance apparatus according to embodiments of the present disclosure will be described below with reference to the drawings.

Figure 2:
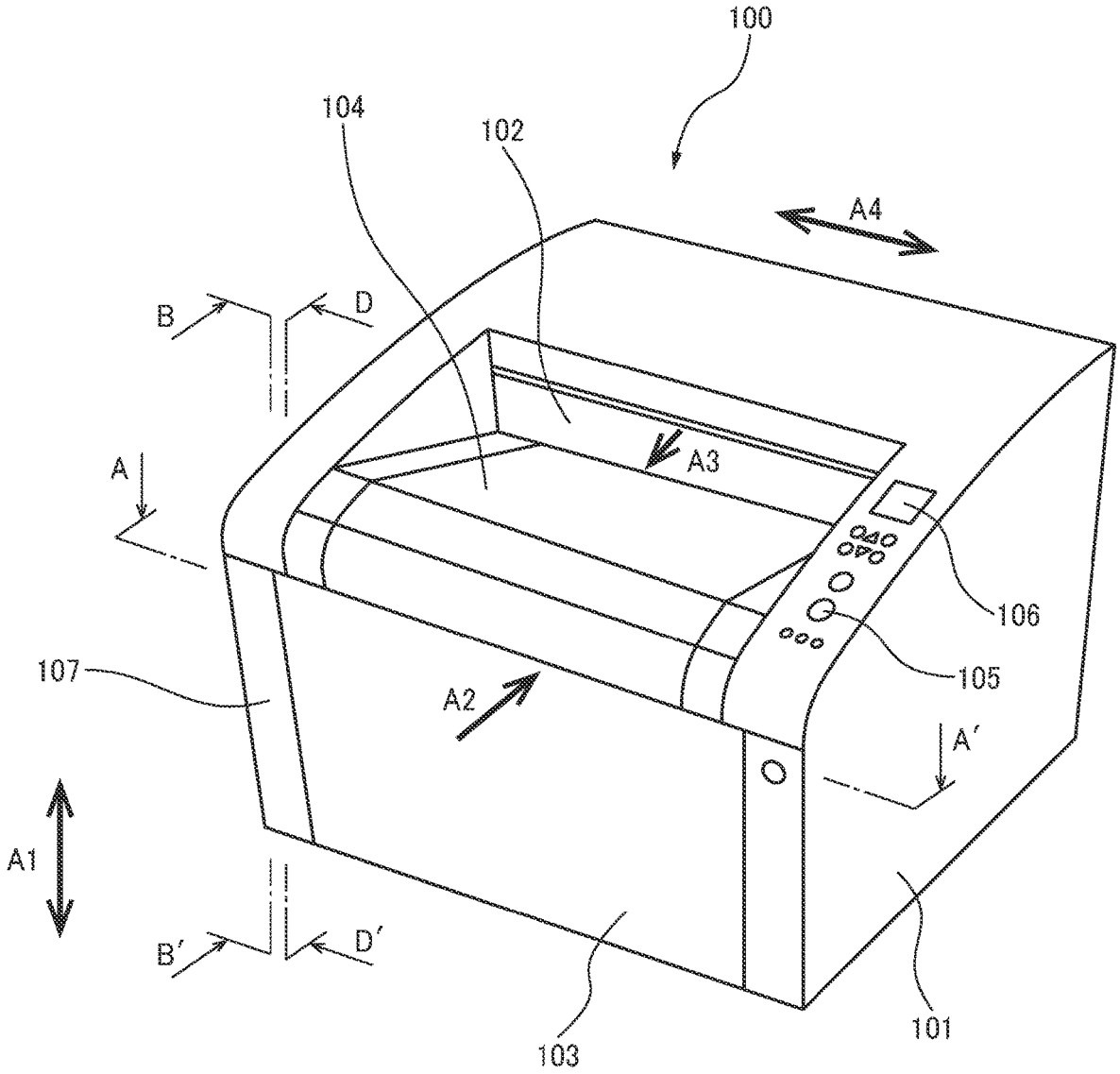
FIG. 2 is another perspective view of a medium conveyance apparatus according to an embodiment of the present disclosure.

FIG. 1 and FIG. 2 are perspective views of the medium conveyance apparatus 100 configured as an image scanner, according to an embodiment of the present disclosure. The medium conveyance apparatus 100 conveys media such as documents, and captures images on the media. The media are, for example, sheets of plain paper, sheets of thick paper, or cards. Alternatively, the medium conveyance apparatus 100 may be, for example, a facsimile machine, a copier, a multifunction peripheral (MFP), or a multifunction printer. The medium to be conveyed may not be a document, and instead, may be printing objects, etc., on which printing is performed. The medium conveyance apparatus 100 may be a printer, etc.

In FIG. 1 and FIG. 2, an arrow A1 indicates a substantially vertical direction (the height direction) and an arrow A2 indicates a conveyance direction in which media are conveyed. In FIG. 1 and FIG. 2, an arrow A3 indicates an ejection direction in which a medium is ejected and an arrow A4 indicates a width direction which is orthogonal to the medium conveyance direction A2 or the medium ejection direction A3. In the following description, the term "upstream" indicates an upstream side in the medium conveyance direction A2 or the medium ejection direction A3, and the term "downstream" indicates a downstream side in the medium conveyance direction A2 or the medium ejection direction A3.

The medium conveyance apparatus 100 according to the present embodiment includes a first housing 101, a second housing 102, a feed tray 103, an output tray 104, an operation device 105, and a display device 106, etc.

The first housing 101 according to the present embodiment is an example of a housing. The second housing 102 is provided inside the first housing 101, and is rotatably engaged with the first housing 101 by a hinge so as to be openable and closable when, for example, a medium is jammed or the inside of the medium conveyance apparatus 100 is to be cleaned. The first housing 101 according to the present embodiment has a frame 107. The frame 107 is arranged inside the first housing 101 to face the feed tray 103 when the feed tray 103 is in the closed state.

The feed tray 103 is a so-called hopper and has a mounting table 103*a* on which media are placed. The feed tray 103 is arranged in the first housing 101 to be openable and closable. The feed tray 103 is rotatably supported on sides of the first housing 101 through which media are fed, by a hinge as will be described later in detail. As illustrated in FIG. 1, the media to be fed and conveyed can be placed on the feed tray 103 when the feed tray 103 is in the opened state. As illustrated in FIG. 2, in a closed state, the feed tray 103 is stored in the first housing 101. The medium conveyance apparatus 100 according to the present embodiment can be reduced in size as the feed tray 103 is accommodated in the first housing 101 when the apparatus is not in use, and users can expand their workspace.

In an opened state, the feed tray 103 is provided to be movable in a height direction A1. In other words, the feed tray 103 is provided to be lifted and lowered. When the medium is not being conveyed, the feed tray 103 is arranged at the bottom end so that the media can easily be placed thereon. When the medium is conveyed, the feed tray 103 is lifted to a position where the medium placed uppermost contacts a pick roller as will be described later in detail.

The feed tray 103 is provided with an engagement part 111. The frame 107 is provided with a to-be-engaged portion 112 that engages with the engagement part 111. The engagement part 111 is, for example, a latch or anchor, and is provided to protrude from a side surface of the feed tray 103. The to-be-engaged portion 112 is, for example, a recess or hole arranged on the inner surface of the frame 107. The engagement part 111 is arranged on at least one end of the feed tray 103 in the width direction A4 to face the to-be-engaged portion 112 when the feed tray 103 is in the closed state. The to-be-engaged portion 112 is arranged on the frame 107 to face the engagement part 111 when the feed tray 103 is in the closed state. As illustrated in FIG. 2, the engagement part 111 engages with the to-be-engaged portion 112. The feed tray 103 is fixed to the frame 107 when accommodated in the frame 107.

For example, the engagement part 111 is arranged at only one side, thus only one end in the width direction A4 (on the left in the illustration of FIG. 1) of the feed tray 103. In that case, the to-be-engaged portion 112 is also arranged on only one side of the frame 107, thus the side in the width direction A4 where the engagement part 111 is arranged (on the left in the illustration of FIG. 1). The engagement part 111 and the to-be-engaged portion 112 are arranged only at one end in the width direction A4, and thus so-called one-sided closure in which only one of the two engaging mechanisms is engaged and the other is not engaged can be prevented. Accordingly, in the medium conveyance apparatus 100 according to the present embodiment, for example, damage to the feed tray 103 can be prevented, and customer convenience can be increased. As the engagement part 111 and the to-be-engaged portion 112 are arranged only at one end in the width direction A4, the number of parts or elements of the medium conveyance apparatus 100 can be reduced and the structure or configuration of those elements or parts can be simplified, and the production cost of the medium conveyance apparatus 100 can be reduced.

Engagement parts 111 may be arranged on both sides of the feed tray 103. In other words, the engagement parts 111 may be arranged at both ends of the feed tray 103 in the width direction A4. In such cases, to-be-engaged portions 112 are also arranged on both sides of the frame 107. In other words, to-be-engaged portions 112 are arranged at both ends in the width direction A4.

The output tray 104 is arranged in the second housing 102 to be openable and closable. The output tray 104 is rotatably supported on the upper surface of the second housing 102 by a hinge. The output tray 104 can receive and hold the medium ejected from the ejection port of the first housing 101 and the second housing 102. In an opened state, the output tray 104 can extend the area on which media are placed, and in a closed state, the output tray 104 is accommodated in the second housing 102.

The operation device 105 includes an input device such as keys, and an interface circuit that obtains a signal from the input device. The operation device 105 accepts an input operation from a user, and outputs an operational signal according to the input operation from the user. The display device 106 according to the present embodiment includes a display including a liquid crystal, an organic electroluminescence (EL), etc., and an interface circuit for outputting image data to the display, and displays the image data on the display.

Figure 3:
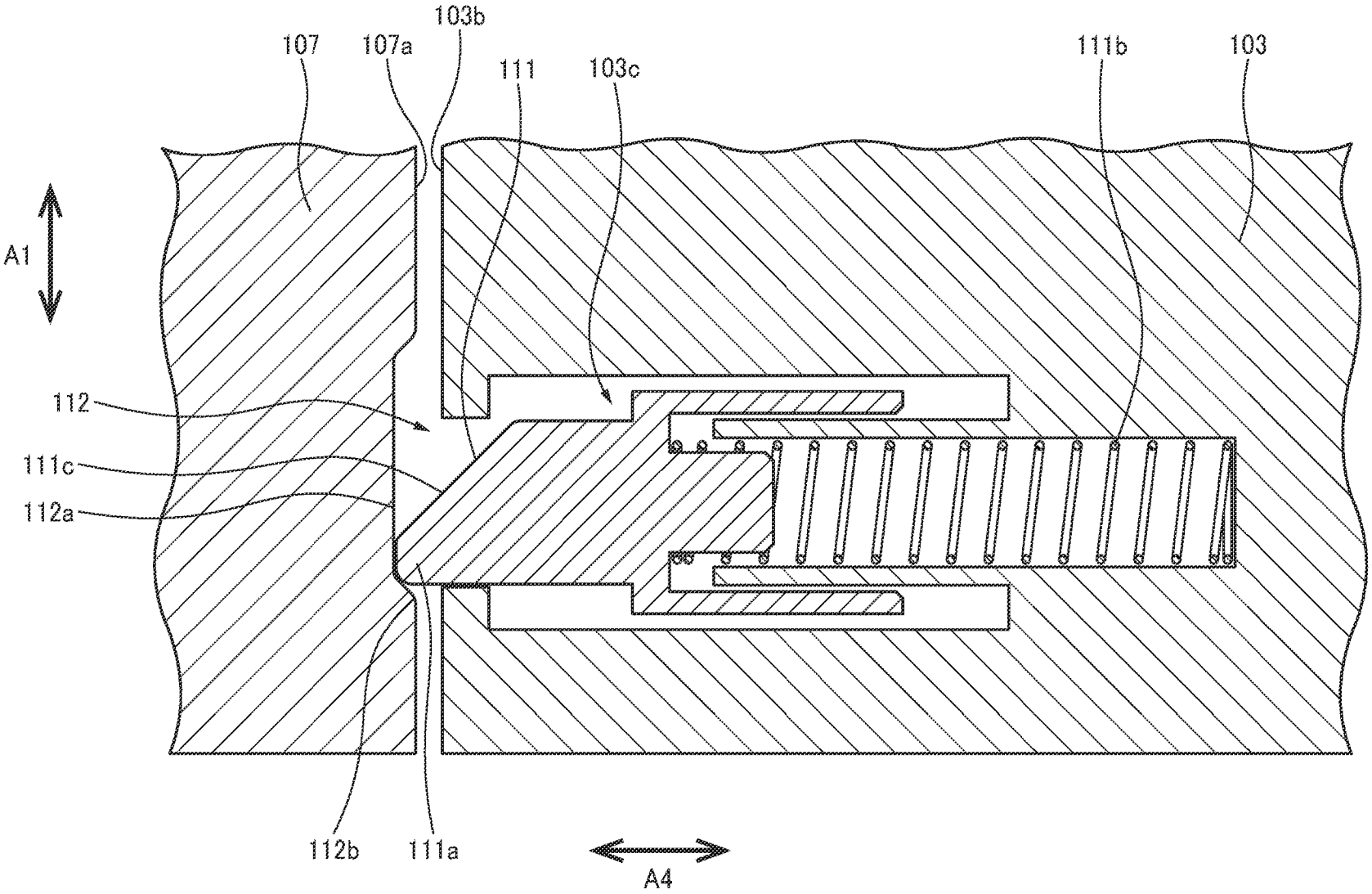
FIG. 3 is a schematic diagram illustrating an engagement part and a to-be-engaged portion, according to an embodiment of the present disclosure.

FIG. 3 is a schematic diagram illustrating the engagement part 111 and the to-be-engaged portion 112, according to the present embodiment.

FIG. 3 is an A-A' sectional view of the medium conveyance apparatus 100 in FIG. 2, according to the present embodiment. In other words, in FIG. 3, the feed tray 103 is in the closed state and the engagement part 111 is engaged with the to-be-engaged portion 112.

As illustrated in FIG. 3, a hole 103*c* extending in the width direction A4 is formed on a first side surface 103*b* of the feed tray 103, and the engagement part 111 is arranged in the hole 103*c*. The engagement part 111 includes a protrusion 111*a* and an elastic member 111*b*. The protrusion 111*a* is formed of resin such as plastic or metal such as iron, and is arranged at the open side of the hole 103*c* (the side of the to-be-engaged portion 112). For example, the elastic member 111*b* is formed of a rubber member or a spring member such as a compression coil spring. One end of the elastic member 111*b* is attached to the protrusion 111*a*, and the other end of the elastic member 111*b* is attached to the bottom of the hole 103*c*. The elastic member 111*b* applies force to the protrusion 111*a* toward the to-be-engaged portion 112.

When the feed tray 103 is in the opened state, the protrusion 111*a* projects from the hole 103*c* by the force applied by the elastic member 111*b*. When the feed tray 103 is closed by a user, an inclined portion 111*c* contacts the front side of the frame 107, and the protrusion 111*a* is pressed by the frame 107 and pushed into the hole 103*c*. Subsequently, the protrusion 111*a* moves while contacting the first inner side surface 107*a* of the frame 107, and contacts the bottom 112*a* of the to-be-engaged portion 112. The protrusion 111*a* is pressed against the bottom 112*a* of the to-be-engaged portion 112 by the force applied by the elastic member 111*b*, and the engagement part 111 is engaged with the to-be-engaged portion 112. As described above, the engagement part 111 is engaged with the to-be-engaged portion 112 when the feed tray 103 is in the closed state, and the closed state of the feed tray 103 is maintained.

By contrast, when the feed tray 103 is opened by a user, the front end of the protrusion 111*a* moves along an inclined portion 112*b* formed on the edge of the to-be-engaged portion 112, and the protrusion 111*a* is pressed by the frame 107 and pushed into the hole 103*c*. Subsequently, the protrusion 111*a* moves while contacting the first inner side surface 107*a* of the frame 107, and projects from the hole 103*c* by the force applied by the elastic member 111*b* when separated from the frame 107.

Figure 4:
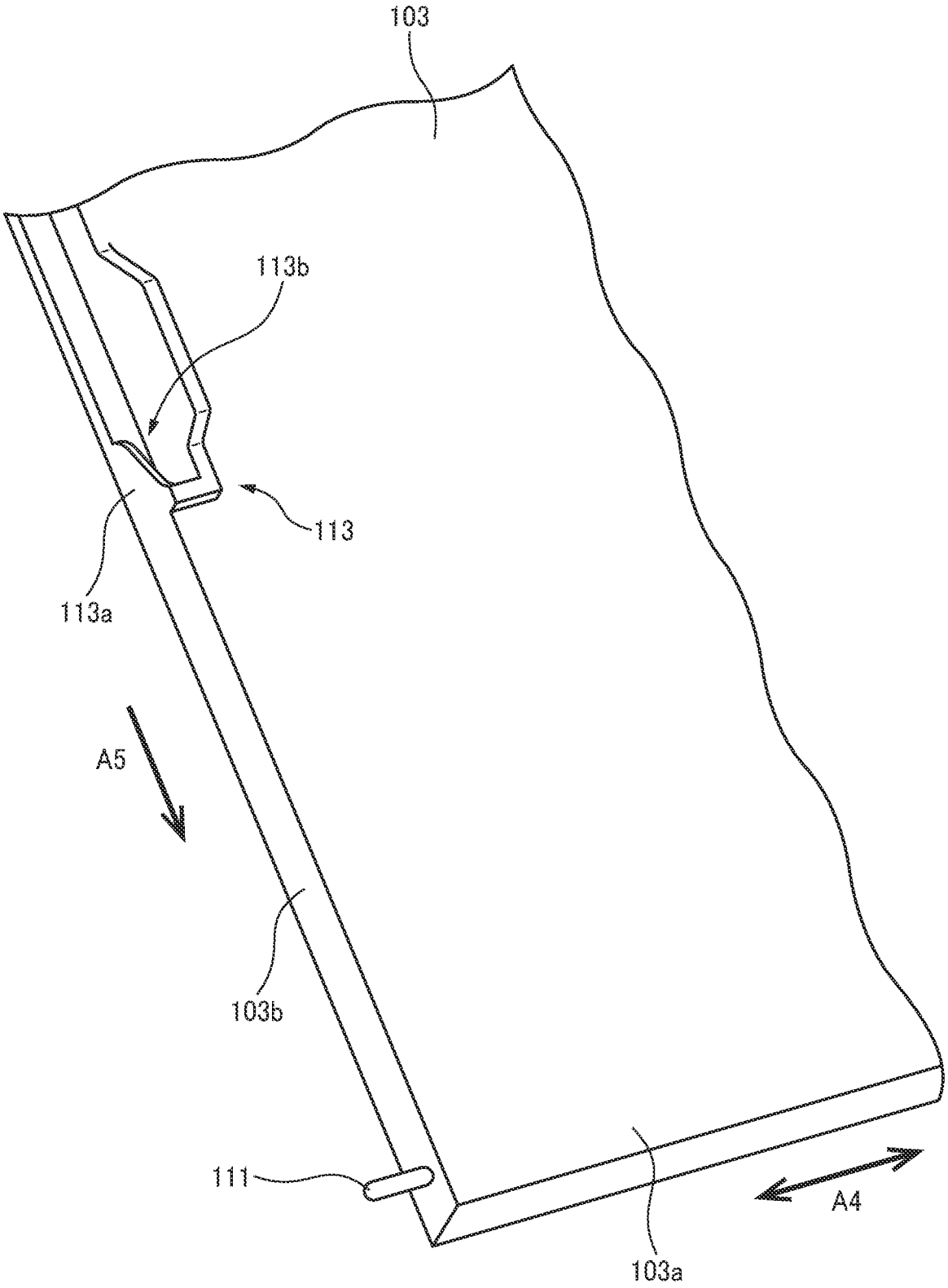
FIG. 4 is a schematic diagram illustrating a feed tray according to an embodiment of the present disclosure.

FIG. 4 is a schematic diagram illustrating the feed tray 103 according to the present embodiment.

More specifically, FIG. 4 illustrates an area around one side of the feed tray 103 detached from the frame 107 (the first housing 101), according to the present embodiment.

As illustrated in FIG. 4, a first contact portion 113 is arranged on the first side surface 103*b* of the feed tray 103, in addition to the engagement part 111. The first contact portion 113 according to the present embodiment is an example of a contact portion. The first contact portion 113 is shaped like a hook extending in the extending direction A5 parallel to the mounting table 103*a* and orthogonal to the width direction A4 and is bent toward the outside in the width direction A4 (the side of a first inner side surface 107*a* of the frame 107 described later in detail). The hook-shaped tip 113*a* extends in the direction opposite to the extending direction A5, and has a contact surface 113*b* inside.

Figure 5:
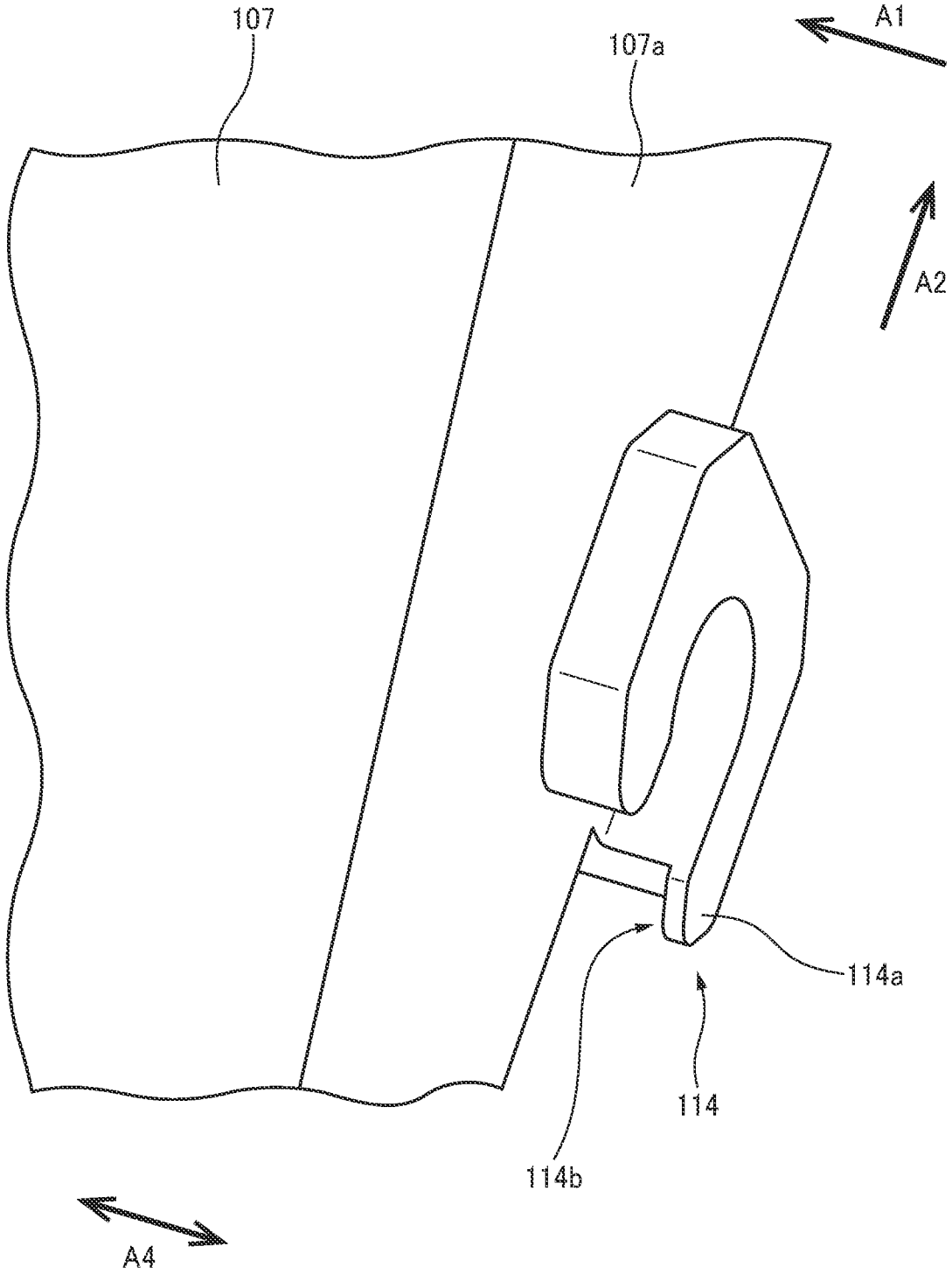
FIG. 5 is a schematic diagram illustrating a frame according to an embodiment of the present disclosure.

FIG. 5 is a schematic diagram illustrating the frame 107 according to the present embodiment.

More specifically, FIG. 5 illustrates an area around the side surface formed on the inner side of the frame 107 when the feed tray 103 is removed.

As illustrated in FIG. 5, a first to-be-contacted portion 114 is arranged on the first inner side surface 107*a* of the frame 107. The first to-be-contacted portion 114 according to the present embodiment is an example of a to-be-contacted portion. The first to-be-contacted portion 114 is shaped like a hook extending in the medium conveyance direction A2 and is bent toward the inside in the width direction A4 (the side of the first side surface 103*b* of the feed tray 103). The hook-shaped tip 114*a* extends in the direction opposite to the conveyance direction A2 of the media, and has a to-be-contacted surface 114*b* inside.

Figure 6:
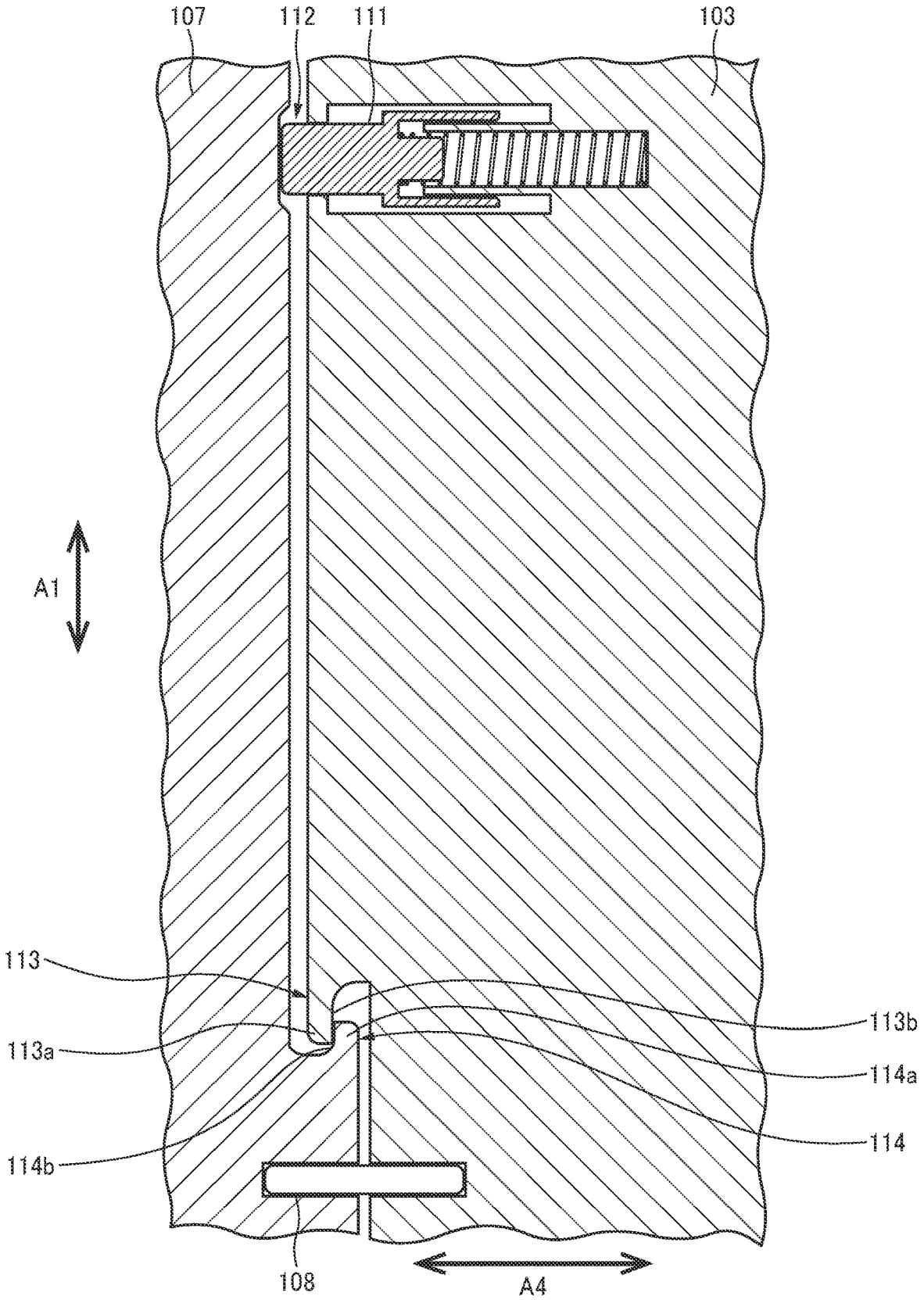
FIG. 6 is a schematic diagram illustrating a first contact portion, etc., according to an embodiment of the present disclosure.
Figure 7B:
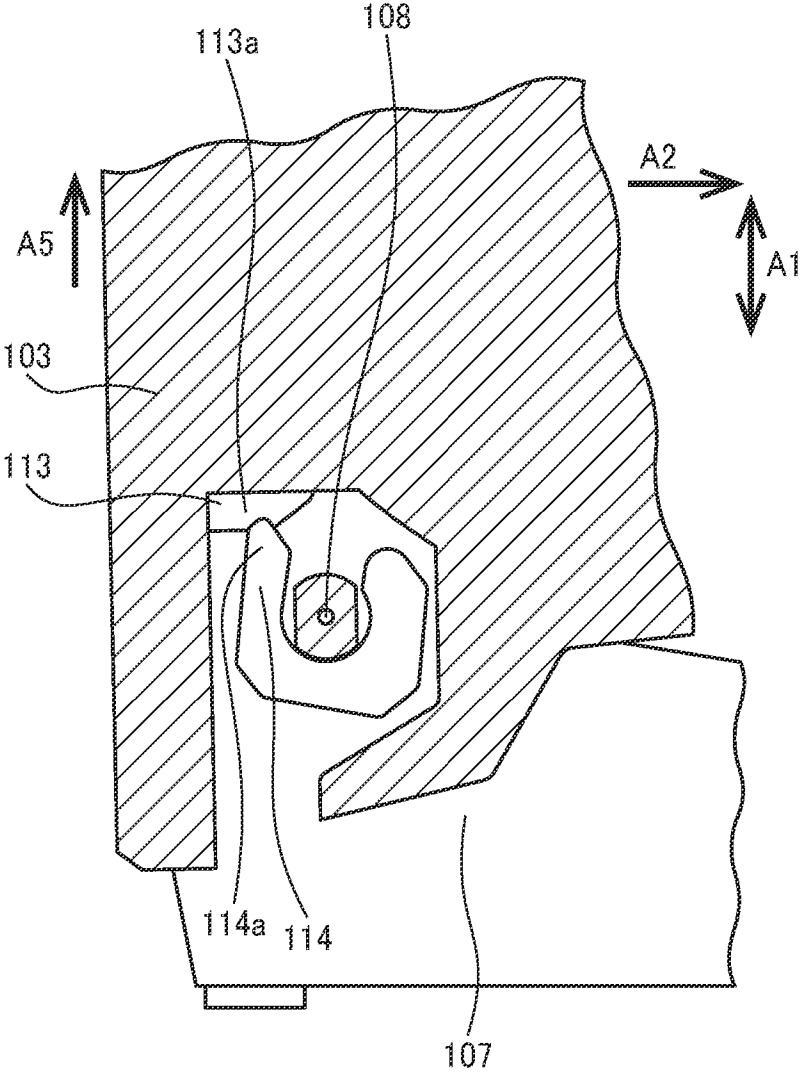
FIG. 7A and FIG. 7B are schematic diagrams illustrating a first contact portion, etc., according to an embodiment of the present disclosure.
Figure 7A:
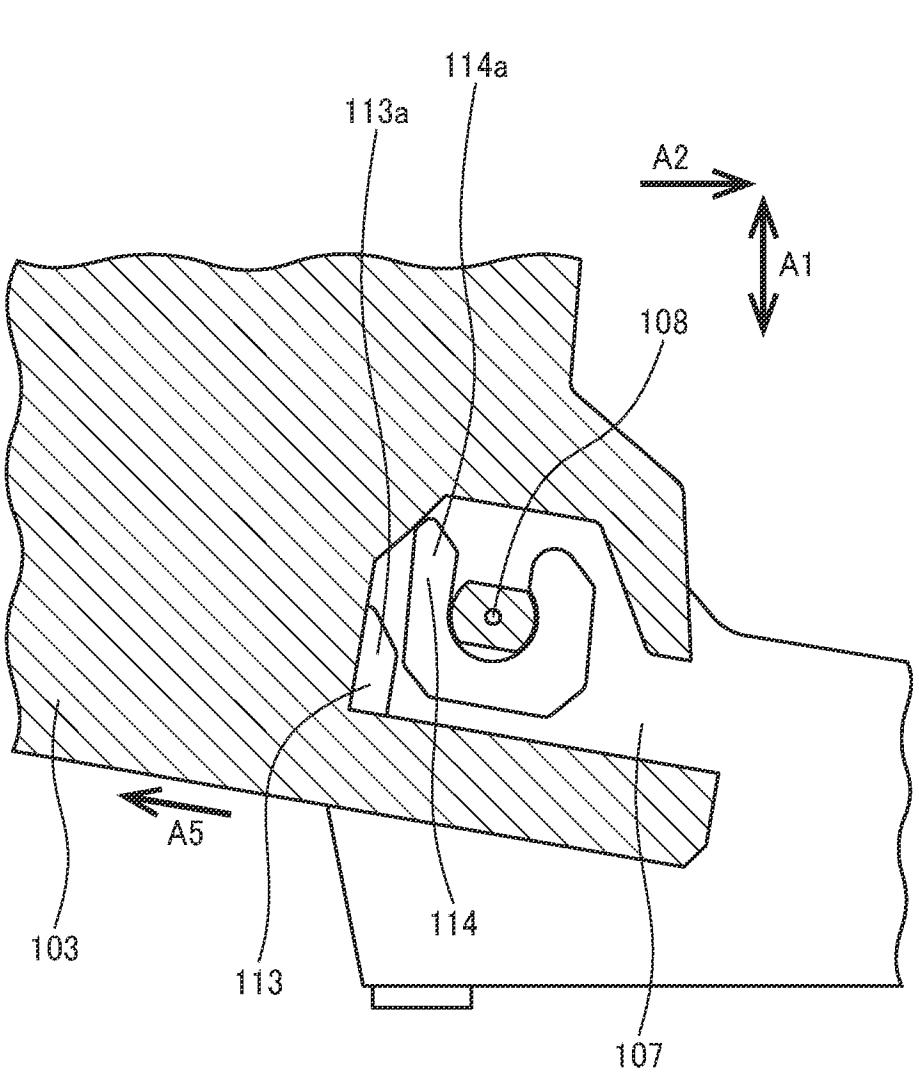

FIG. 6, FIG. 7A, and FIG. 7B are schematic diagrams illustrating the first contact portion 113 and the first to-be-contacted portion 114, according to the present embodiment.

FIG. 6 is a B-B' sectional view of the medium conveyance apparatus 100 in FIG. 2, according to the present embodiment.

FIG. 7A is a C-C' sectional view of the medium conveyance apparatus 100 of FIG. 1, according to the present embodiment.

FIG. 7B is a D-D' sectional view of the medium conveyance apparatus 100 of FIG. 2, according to the present embodiment.

In other words, in FIG. 7A, the feed tray 103 is in the opened state, and in FIG. 6 and FIG. 7B, the feed tray 103 is in the closed state.

As illustrated in FIG. 7A, when the feed tray 103 is in the opened state, the tip 113*a* of the first contact portion 113 is arranged at a position not facing the tip 114*a* of the first to-be-contacted portion 114, and the contact surface 113*b* of the first contact portion 113 does not contact the to-be-contacted surface 114*b* of the first to-be-contacted portion 114. Therefore, when the feed tray 103 is in the opened state, the first contact portion 113 and the first to-be-contacted portion 114 do not restrict the movement of the feed tray 103 in the width direction A4 with respect to the frame 107. Accordingly, the feed tray 103 in the opened state can be smoothly rotated, and the feed tray 103 can easily be opened or closed by a user.

As illustrated in FIG. 6 and FIG. 7B, when the feed tray 103 is in the closed state, the tip 113*a* of the first contact portion 113 is arranged at a position facing the tip 114*a* of the first to-be-contacted portion 114, and the contact surface 113*b* of the first contact portion 113 contacts the to-be-contacted surface 114*b* of the first to-be-contacted portion 114. Therefore, when the feed tray 103 is in the closed state, the first contact portion 113 and the first to-be-contacted portion 114 restrict the movement of the feed tray 103 in the width direction A4. More specifically, the first contact portion 113 and the first to-be-contacted portion 114 restrict the movement of the feed tray 103 in the direction in which the engagement part 111 is separated from the to-be-engaged portion 112 (in the right direction in FIG. 6).

As described above, when the feed tray 103 is in the closed state, the first contact portion 113 contacts the first to-be-contacted portion 114 and the movement of the feed tray 103 is restricted, thereby restricting separation of the engagement part 111 from the to-be-engaged portion 112. When the medium conveyance apparatus 100 with the feed tray 103 in the closed state is subjected to vibration, etc., the engagement between the engagement part 111 and the to-be-engaged portion 112 is prevented from being released and thereby preventing the opening of the feed tray 103. Even when a gap is present between the feed tray 103 and the frame 107 due to variations in, for example, the sizes of components or elements at the time of manufacture, the feed tray 103 is prevented from moving in the width direction A4, and the engagement between the engagement part 111 and the to-be-engaged portion 112 is prevented from being released and thereby preventing opening of the feed tray 103.

In particular, each of the first contact portion 113 and the first to-be-contacted portion 114 is shaped like a hook that has the contact surface 113*b* and the to-be-contacted surface 114*b* inside. And when the feed tray 103 is in the closed state, the contact surface 113*b* contacts the first to-be-contacted portion 114 and the movement of the feed tray 103 is restricted, thereby restricting separation of the engagement part 111 from the to-be-engaged portion 112. The hook-shaped portion can be easily formed, and the first contact portion 113 and the first to-be-contacted portion 114 can easily be formed at low cost. Therefore, in the medium conveyance apparatus 100 according to the present embodiment, the feed tray 103 in the closed state can be prevented from opening while preventing an increase in the production cost of the medium conveyance apparatus 100.

As illustrated in FIG. 6, the feed tray 103 according to the present embodiment is rotatably supported by the frame 107, thus the first housing 101 through a hinge 108. The first contact portion 113 is arranged at a position between the hinge 108, which is the rotation axis of the feed tray 103, and the engagement part 111. In other words, the distance between the first contact portion 113 and the hinge 108 is smaller than the distance between the engagement part 111 and the hinge 108. When the distance from the rotation axis to the first contact portion 113 is small in the feed tray 103, the range in which the first contact portion 113 moves during the rotation of the feed tray 103 is small. Accordingly, even if the positions at which the first contact portion 113 and the first to-be-contacted portion 114 are arranged are slightly shifted from each other when the engagement part 111 is engaged with the to-be-engaged portion 112, it is likely that the first contact portion 113 contacts the first to-be-contacted portion 114 appropriately. Accordingly, in the medium conveyance apparatus 100 according to the present embodiment, the influence of the manufacturing error can be reduced, and the yield rate can be increased.

In the medium conveyance apparatus 100 according to the present embodiment, the feed tray 103 is brought into contact with the frame 107 using the first contact portion 113 and the first to-be-contacted portion 114 having a hook-like shape. The movement of the feed tray 103 can appropriately be restricted. The feed tray 103 and the frame 107 are provided to be separable from each other easily, and when the inside of the medium conveyance apparatus 100 is to be cleaned or when the medium is jammed, etc., the feed tray 103 can easily be detached from the frame 107 by a user. Therefore, customer convenience of the medium conveyance apparatus 100 according to the present embodiment can be increased.

Figure 8:
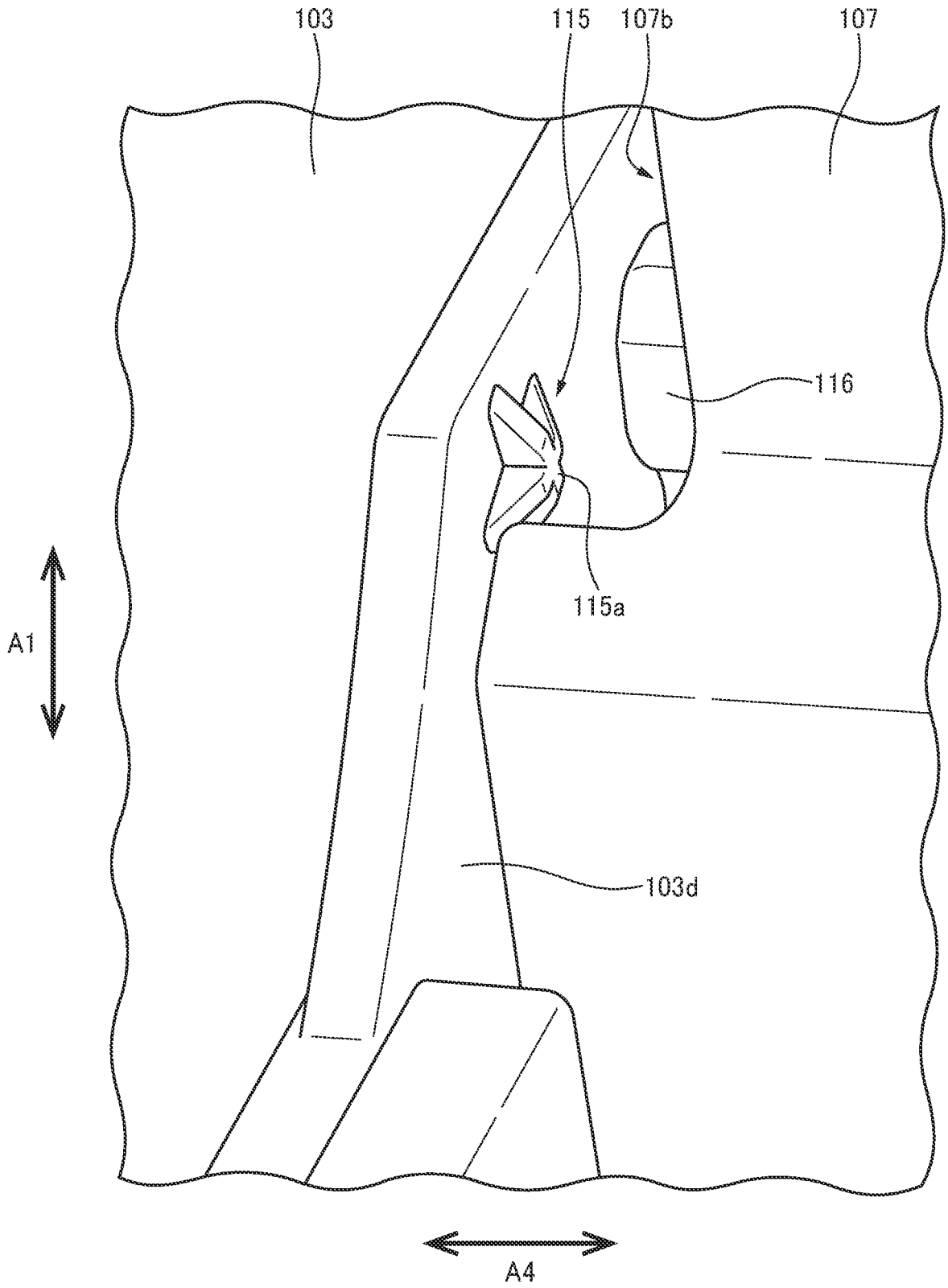
FIG. 8 is a schematic diagram illustrating a feed tray and a frame, according to an embodiment of the present disclosure.

FIG. 8 is a schematic diagram illustrating the feed tray 103 and the frame 107, according to the present embodiment. FIG. 8 is a diagram illustrating an area around a second side surface 103*d* of the feed tray 103 and an area around a second inner side surface 107*b* of the frame 107 when the feed tray 103 is in the opened state, according to the present embodiment. The second side surface 103*d* is arranged on the other side of the first side surface 103*b* on which the first contact portion 113 is arranged, and the second inner side surface 107*b* is arranged on the other side of the first inner side surface 107*a* on which the first to-be-contacted portion 114 is arranged.

As illustrated in FIG. 8, a second contact portion 115 is arranged on the second side surface 103*d* of the feed tray 103. The second contact portion 115 according to the present embodiment is an example of a contact portion. The second contact portion 115 has a projecting part 115*a* formed to protrude from the second side surface 103*d* toward the outside in the width direction A4 (the side of the second inner side surface 107*b* of the frame 107). The projecting part 115*a* is shaped like a cross whose sides are inclined such that the center projects the most. A second to-be-contacted portion 116 is arranged on the second inner side surface 107*b* of the frame 107. The second to-be-contacted portion 116 according to the present embodiment is an example of a to-be-contacted portion. The second to-be-contacted portion 116 is formed to protrude from the second inner side surface 107*b* toward the inside in the width direction A4 (the side of the second side surface 103*d* of the feed tray 103).

Figure 9A:
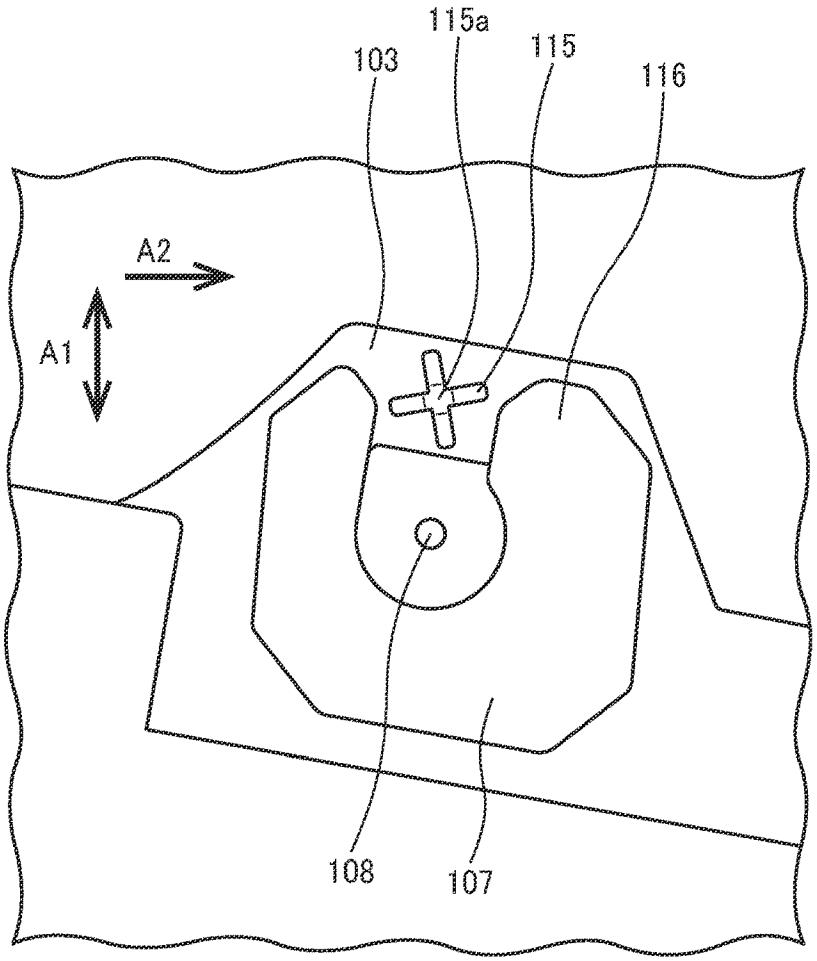
FIG. 9A and FIG. 9B are schematic diagrams each illustrating a second contact portion, etc., according to an embodiment of the present disclosure.
Figure 9B:
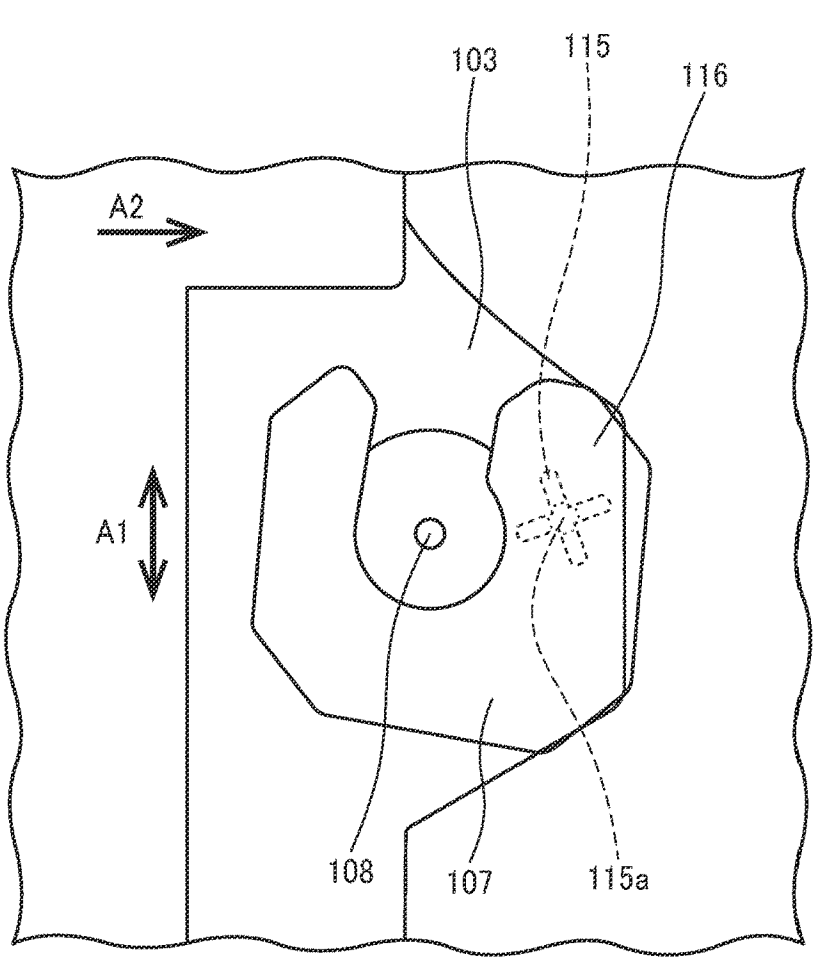

FIG. 9A and FIG. 9B are schematic diagrams illustrating the second contact portion 115 and the second to-be-contacted portion 116, according to the present embodiment.

FIG. 9A is a schematic side view of an area around the second inner side surface 107*b* of the frame 107 and the second side surface 103*d* of the feed tray 103 in the opened state, according to the present embodiment.

FIG. 9B is a schematic side view of an area around the second inner side surface 107*b* of the frame 107 and the second side surface 103*d* of the feed tray 103 in the closed state, according to the present embodiment.

As illustrated in FIG. 9A, when the feed tray 103 is in the opened state, the projecting part 115*a* of the second contact portion 115 is arranged at a position not facing the second to-be-contacted portion 116, and the projecting part 115*a* does not contact the second to-be-contacted portion 116. When the feed tray 103 is in the opened state, the second contact portion 115 and the second to-be-contacted portion 116 do not restrict the movement of the feed tray 103 in the width direction A4 with respect to the frame 107. Accordingly, the feed tray 103 in the opened state can be smoothly rotated, and the feed tray 103 can easily be opened or closed by a user.

By contrast, when the feed tray 103 is in the closed state as illustrated in FIG. 9B, the projecting part 115*a* of the second contact portion 115 is arranged at a position facing the second to-be-contacted portion 116, and the projecting part 115*a* contacts the second to-be-contacted portion 116. When the feed tray 103 is in the closed state, the second contact portion 115 and the second to-be-contacted portion 116 restrict the movement of the feed tray 103 in the width direction A4 where the engagement part 111 moves away from the to-be-engaged portion 112 (the right direction in FIG. 8). As the projecting part 115*a* is inclined, the second contact portion 115 smoothly slides along the second to-be-contacted portion 116 when the feed tray 103 in the closed state opens or when the feed tray 103 in the opened state is closed. Accordingly, the feed tray 103 can be opened or closed as desired by a user.

As described above, when the feed tray 103 is in the closed state, the projecting part 115*a* of the second contact portion 115 contacts to the second to-be-contacted portion 116 and the movement of the feed tray 103 is restricted, thereby restricting the separation of the engagement part 111 from the to-be-engaged portion 112. When the feed tray 103 is in the closed state and the medium conveyance apparatus 100 is subjected to vibration, etc., the engagement between the engagement part 111 and the to-be-engaged portion 112 is prevented from being released and the feed tray 103 is prevented from opening. The projecting part 115*a* can be easily formed, and the second contact portion 115 and the second to-be-contacted portion 116 can easily be formed at low cost. Accordingly, in the medium conveyance apparatus 100 according to the present embodiment, the feed tray 103 in the closed state can be prevented from opening while preventing an increase in the production cost of the medium conveyance apparatus 100.

In a similar manner to the first contact portion 113, the second contact portion 115 is arranged at a position between the hinge 108 and the engagement part 111 in the extending direction A5 of the feed tray 103. In other words, the distance between the second contact portion 115 and the hinge 108 is smaller than the distance between the engagement part 111 and the hinge 108. When the engagement part 111 and the to-be-engaged portion 112 are engaged with each other, it is likely that the second contact portion 115 contacts the second to-be-contacted portion 116 appropriately even if the positions at which the second contact portion 115 and the second to-be-contacted portion 116 are arranged are slightly shifted from each other. Accordingly, in the medium conveyance apparatus 100 according to the present embodiment, the influence of the manufacturing error can be reduced, and the yield rate can be increased.

In the medium conveyance apparatus 100 according to the present embodiment, the feed tray 103 is brought into contact with the frame 107 using the second to-be-contacted portion 116 and the second contact portion 115 having the projecting part 115*a*. Therefore, the movement of the feed tray 103 can appropriately be restricted, and the feed tray 103 and the frame 107 can easily be separated from each other. Moreover, when the inside of the medium conveyance apparatus 100 is to be cleaned or when the medium is jammed, etc., the feed tray 103 can easily be detached from the frame 107 by a user. Therefore, customer convenience of the medium conveyance apparatus 100 according to the present embodiment can be increased.

Figure 10:
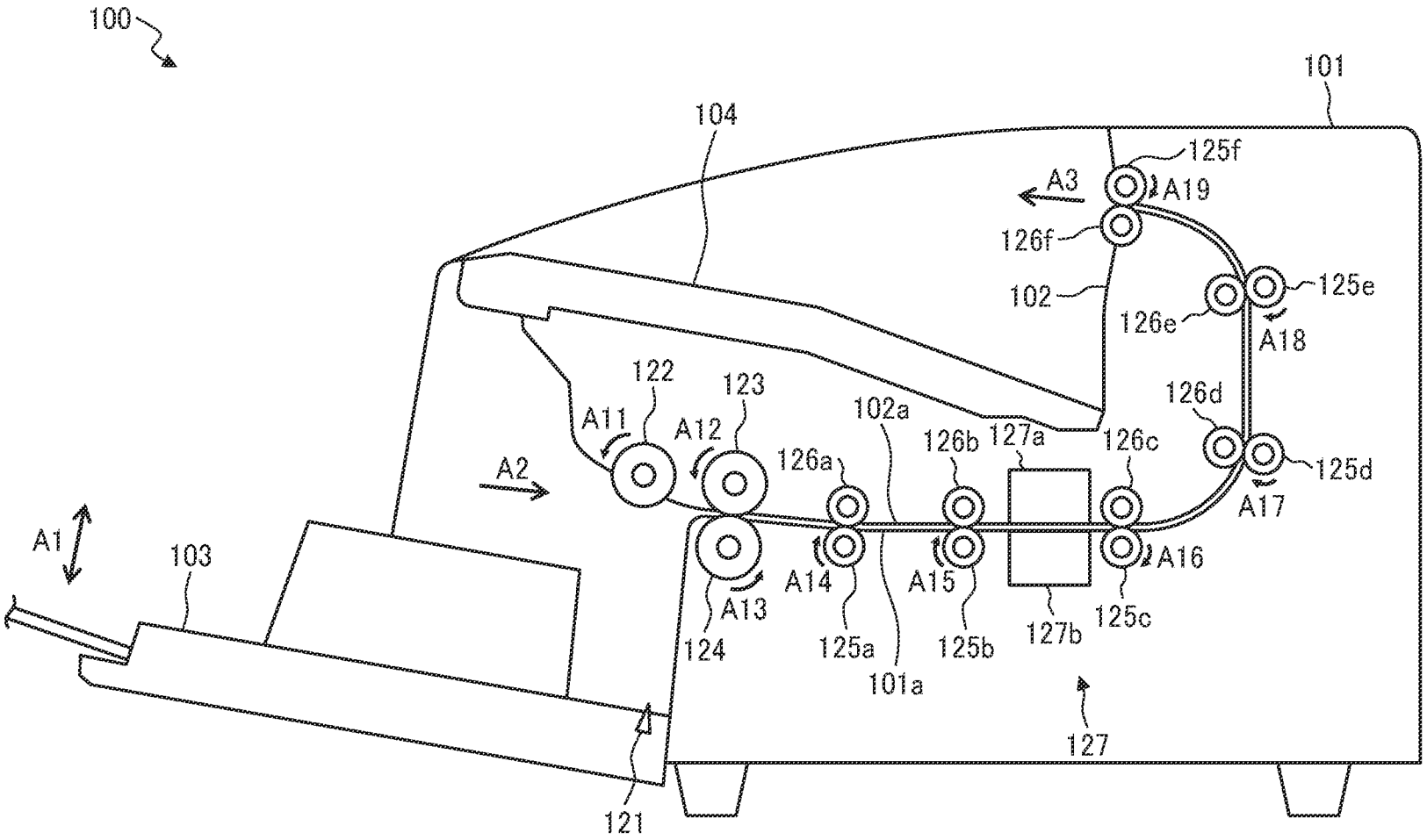
FIG. 10 is a diagram illustrating a conveyance path inside a medium conveyance apparatus, according to an embodiment of the present disclosure.

FIG. 10 is a diagram illustrating a conveyance path inside the medium conveyance apparatus 100, according to the present embodiment.

A conveyance path inside the medium conveyance apparatus 100 according to the present embodiment includes a medium sensor 121, a pick roller 122, a feed roller 123, a separation roller 124, first to sixth conveyance rollers 125*a* to 125*f*, first to sixth driven rollers 126*a* to 126*f*, an imaging device 127, etc., along the conveyance path.

The number of each of the pick roller 122, the feed roller 123, the separation roller 124, the first to sixth conveyance rollers 125*a* to 125*f*, and/or the first to sixth driven rollers 126*a* to 126*f* is not limited to one, and may be two or more. In such cases, the multiple feed rollers 123, the multiple separation rollers 124, the first to sixth conveyance rollers 125*a* to 125*f* and/or the first to sixth driven rollers 126*a* to 126*f* are arranged at intervals in the width direction A4.

The first housing 101 has a surface that faces the second housing 102 and makes up a first guide 101*a* of the medium conveyance path. The second housing 102 has a surface that faces the first housing 101 and makes up a second guide 102*a* of the medium conveyance path.

The medium sensor 121 according to the present embodiment is arranged on the feed tray 103 to detect whether a medium is placed on the feed tray 103. In other words, the medium sensor 121 is arranged upstream from the feeding roller 123 and the separation roller 124 to detect whether a medium is placed on the feed tray 103. The medium sensor 121 determines whether any medium is placed on the feed tray 103, using a contact sensor that feeds a predetermined amount of electric current when a medium is contacting the sensor or when no medium is contacting the sensor. The medium sensor 121 generates and outputs a medium signal whose signal value changes between when a medium is placed on the feed tray 103 and when no medium is placed on the feed tray 103. The medium sensor 121 is not limited to the contact sensor but may be any other sensors such as optical sensors that can detect whether a medium is present.

The pick roller 122 is provided for the second housing 102, and contacts the uppermost medium of the multiple media placed on the feed tray 103 lifted to substantially the same height as the height of the medium conveyance path, and feeds and conveys the medium downstream in the medium conveyance direction A2.

The feed roller 123 is arranged downstream from the pick roller 122 in the second housing 102, and feeds the medium placed on the feed tray 103 and fed by the pick roller 122 to a further downstream side. The separation roller 124 is arranged in the first housing 101 to face the feed roller 123. The separation roller 124 is a so-called brake roller or retard roller, and is provided to be rotatable in the direction opposite to the medium feeding direction. Alternatively, the separation roller 124 may be provided to be stoppable. The feeding roller 123 and the separation roller 124 separate the multiple media from each other, and feed the medium one-by-one. The feeding roller 123 is arranged above the separation roller 124, and the medium conveyance apparatus 100 feeds the media from the top.

The first to sixth conveyance rollers 125*a* to 125*f* and the first to sixth driven rollers 126*a* to 126*f* are arranged downstream from the feed roller 123 and the separation roller 124 to face each other, and convey the medium fed by the feeding roller 123 and the separation roller 124 to a further downstream side. The sixth conveyance roller 125*f* and the sixth driven roller 126*f* eject the media to the output tray 104.

The imaging device 127 is arranged downstream in the medium conveyance direction A2 from the first and second conveyance rollers 125*a* and 125*b* to capture an image of the medium conveyed by the first and second conveyance rollers 125*a* and 125*b* and the first and second driven rollers 126*a* and 126*b*. The imaging device 127 includes a first imaging device 127*a* and a second imaging device 127*b* arranged to face each other with the conveyance path of the media in between.

The first imaging device 127*a* includes, as a line sensor, a contact image sensor (CIS) that employs an optical system of unity magnification, and such a contact image sensor includes, as imaging devices, complementary metal-oxide semiconductors (CMOS) that are linearly arranged in the main scanning direction. The first imaging device 127*a* further includes a lens that forms an image on the imaging devices, and an analog-to-digital (A/D) converter that amplifies the electrical signals output from the imaging devices to perform analog-to-digital (A/D) conversion on the amplified electrical signals. The first imaging device 127*a* captures an image of the front side of the medium being conveyed to generate and output an input image.

In a similar manner to the above, the second imaging device 127*b* includes, as a line sensor, a CIS that employs an optical system of unity magnification and includes complementary metal-oxide semiconductors (CMOS) that are linearly arranged in the main scanning direction. The second imaging device 127*b* further includes a lens that forms an image on the imaging devices, and an analog-to-digital (A/D) converter that amplifies the electrical signals output from the imaging devices to perform analog-to-digital (A/D) conversion on the amplified electrical signals. The second imaging device 127*b* captures an image of the rear side of the medium being conveyed to generate and output an input image.

The medium conveyance apparatus 100 may include either one of the first imaging device 127*a* and the second imaging device 127*b* to read only one side of the medium. Instead of the line sensor provided as a CIS that employs an optical system of unity magnification and includes complementary metal-oxide semiconductors (CMOS) as imaging devices, a line sensor provided as a CIS that employs an optical system of unity magnification and includes charge-coupled devices (CCD) as imaging devices may be used. A line sensor that employs a reduction optical system and includes complementary metal-oxide semiconductors (CMOS) or charge-coupled devices (CCD) as imaging devices may be used.

As the pick roller 122 and the feed roller 123 rotate in medium feeding directions A11 and A12, respectively, the medium placed on the feed tray 103 is conveyed between the first guide 101*a* and the second guide 102*a* in the medium conveyance direction A2. The medium conveyance apparatus 100 has a separation mode in which media are fed while being separated and a non-separation mode in which media are fed without being separated as feeding modes. The feeding mode is set by a user using the operation device 105 or an information processing device coupled to and communicating with the medium conveyance apparatus 100. When the feeding mode is set to the separation mode, the separation roller 124 rotates in the direction indicated by an arrow A13, which is opposite to the medium feeding directions, or stops. A medium other than the medium being separated can be prevented from being fed. By contrast, when the feeding mode is set to the non-separation mode, the separation roller 124 rotates in the direction opposite to the direction indicated by the arrow A13, thus the medium feeding direction.

As the first and second conveyance rollers 125*a* and 125*b* rotate in each one of the directions indicated by arrows A14 and A15, the medium is fed to a position at which an image of the medium is captured by the imaging device 127 while being guided by the first guide 101*a* and the second guide 102*a*. As the third to sixth conveyance rollers 125*c* to 125*f* rotate in the directions indicated by arrows A16 to A19, respectively, the medium is ejected onto the output tray 104.

Figure 11:
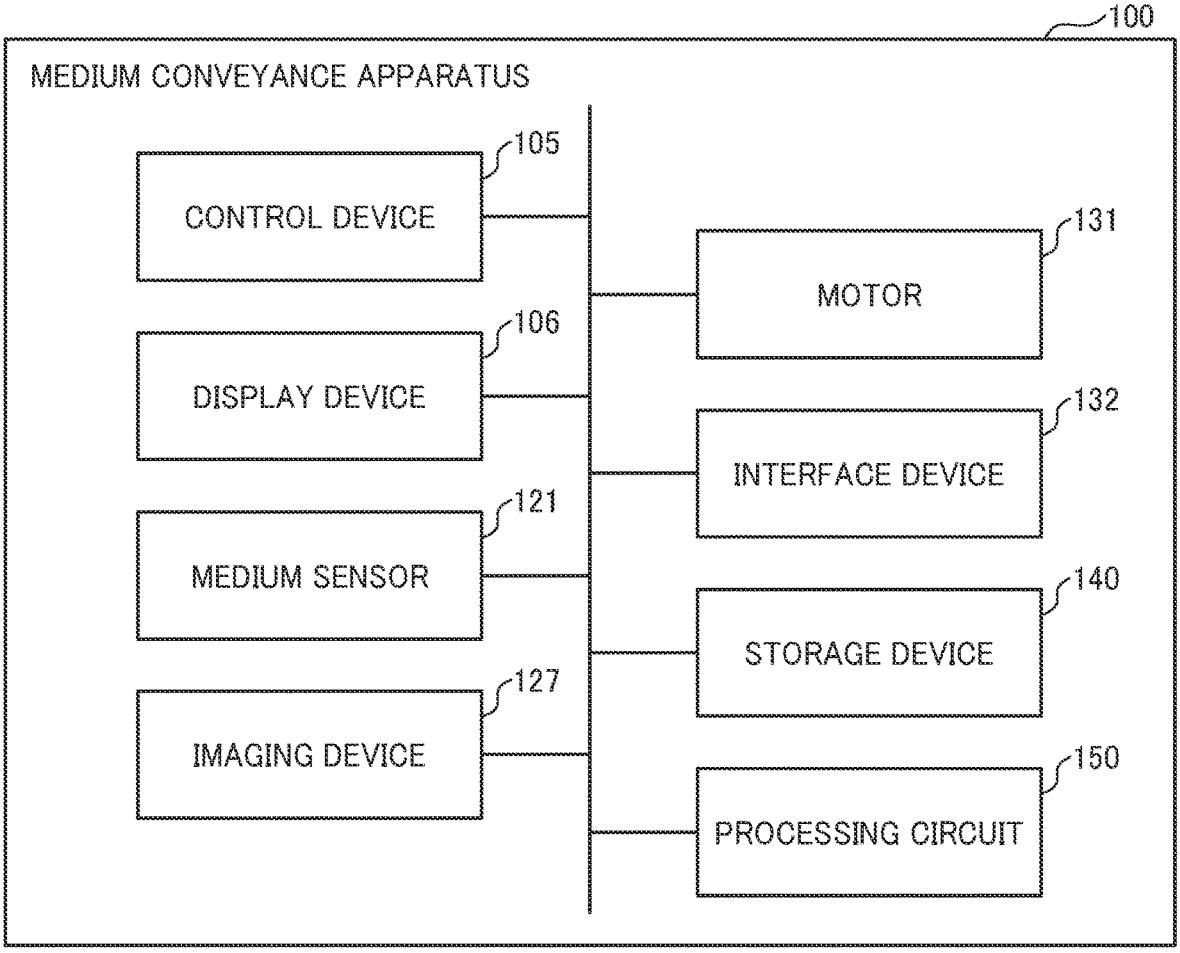
FIG. 11 is a block diagram illustrating a schematic configuration of a medium conveyance apparatus according to an embodiment of the present disclosure.

FIG. 11 is a block diagram illustrating a schematic configuration of the medium conveyance apparatus 100 according to the present embodiment.

The medium conveyance apparatus 100 further includes a motor 131, an interface device 132, a storage device 140, a processing circuit 150, etc., in addition to the structure or configuration described above.

The motor 131 includes one or a plurality of motors. The motor 131 according to the present embodiment drives the pick roller 122, the feed roller 123, the separation roller 124, and the first to sixth conveyance rollers 125*a* to 125*f* according to the control signals from the processing circuit 150 to convey the media, and moves the feed tray 103. The first to sixth driven rollers 126*a* to 126*f* may be driven to rotate by the driving force of the motor 131, instead of being driven to rotate by the first to sixth conveyance rollers 125*a* to 125*f*.

The interface device 132 according to the present embodiment includes an interface circuit adapted to a serial bus such as a universal serial bus (USB), and is electrically connected to an information processing device such as a personal computer (PC) or a mobile information terminal to exchange an input image and various kinds of data with an information processing device. The interface device 132 may be substituted by a communication unit provided with an antenna that transmits and receives a radio signal and a radio communication interface circuit that transmits and receives a signal through a radio communication line according to a predetermined communication protocol. Such a predetermined communication protocol is, for example, a wireless local area network (LAN). The communication unit may include a wired communication interface circuit that transmits and receives signals through a wired communication line according to a communication protocol such as the communication protocol of a wired LAN.

The storage device 140 according to the present embodiment includes, for example, a memory such as a random-access memory (RAM) and a read-only memory (ROM), a fixed disk device such as a hard disk, or a portable storage device such as a flexible disk and an optical disk. The storage device 140 stores, for example, computer programs, databases, and tables used for various kinds of processes performed by the medium conveyance apparatus 100. The computer program may be installed in the storage device 140 from a computer-readable portable recording medium, using a setup program, etc. The portable recording medium is, for example, a compact disc read-only memory (CD-ROM), and a digital versatile disc read-only memory (DVD-ROM).

The processing circuit 150 operates based on a program stored in advance in the storage device 140. The processing circuit 150 is, for example, a central processing unit (CPU). Alternatively, as the processing circuit 150, for example, a digital signal processor (DSP), a large-scale integrated (LSI)

circuit, an application-specific integrated circuit (ASIC), or a field-programmable gate array (FPGA) may be used.

The processing circuit 150 is coupled to the operation device 105, the display device 106, the medium sensor 121, the imaging device 127, the motor 131, the interface device 132, the storage device 140, etc., and controls each of these components. The processing circuit 150 controls, for example, the driving of the motor 131 and the image capturing by the imaging device 127, according to the medium signal received from the medium sensor 121. The processing circuit 150 acquires an input image from the imaging device 127, and transmits the input image to an information processing device through the interface device 132.

Figure 12:
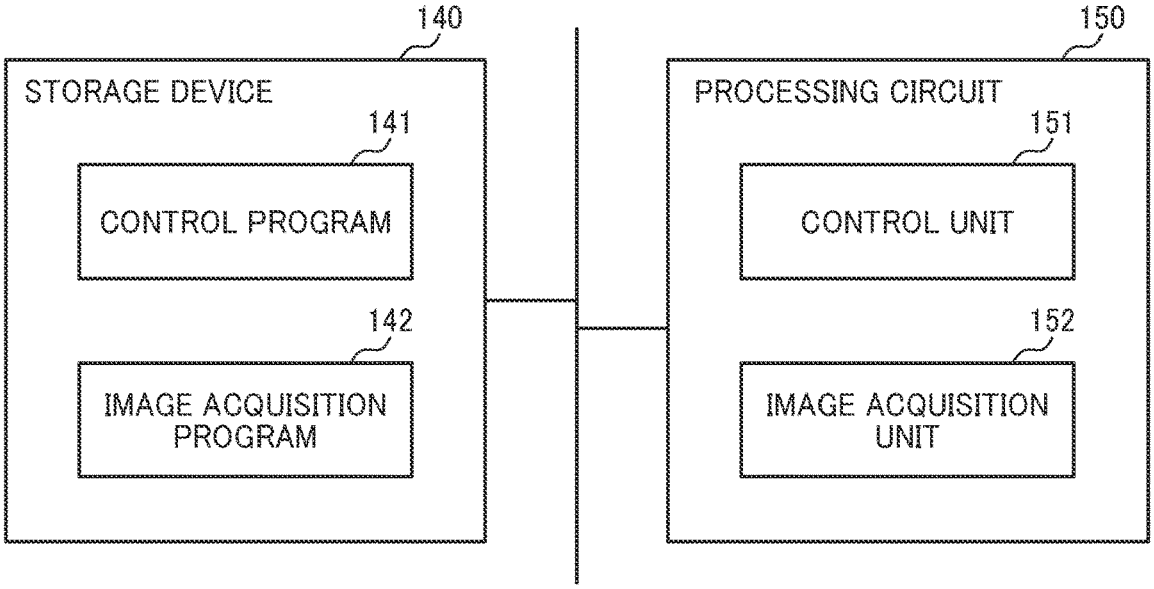
FIG. 12 is a diagram illustrating a schematic configuration of a storage device and a processing circuit, according to an embodiment of the present disclosure.

FIG. 12 is a diagram illustrating a schematic configuration of the storage device 140 and the processing circuit 150, according to the present embodiment.

As illustrated in FIG. 12, the storage device 140 stores a control program 141, an image acquisition program 142, etc. These programs are functional modules implemented by software operating on the processor. The processing circuit 150 reads the multiple programs from the storage device 140 and operates according to the read programs. The processing circuit 150 is an example of the control unit 151 and the image acquisition unit 152.

Figure 13:
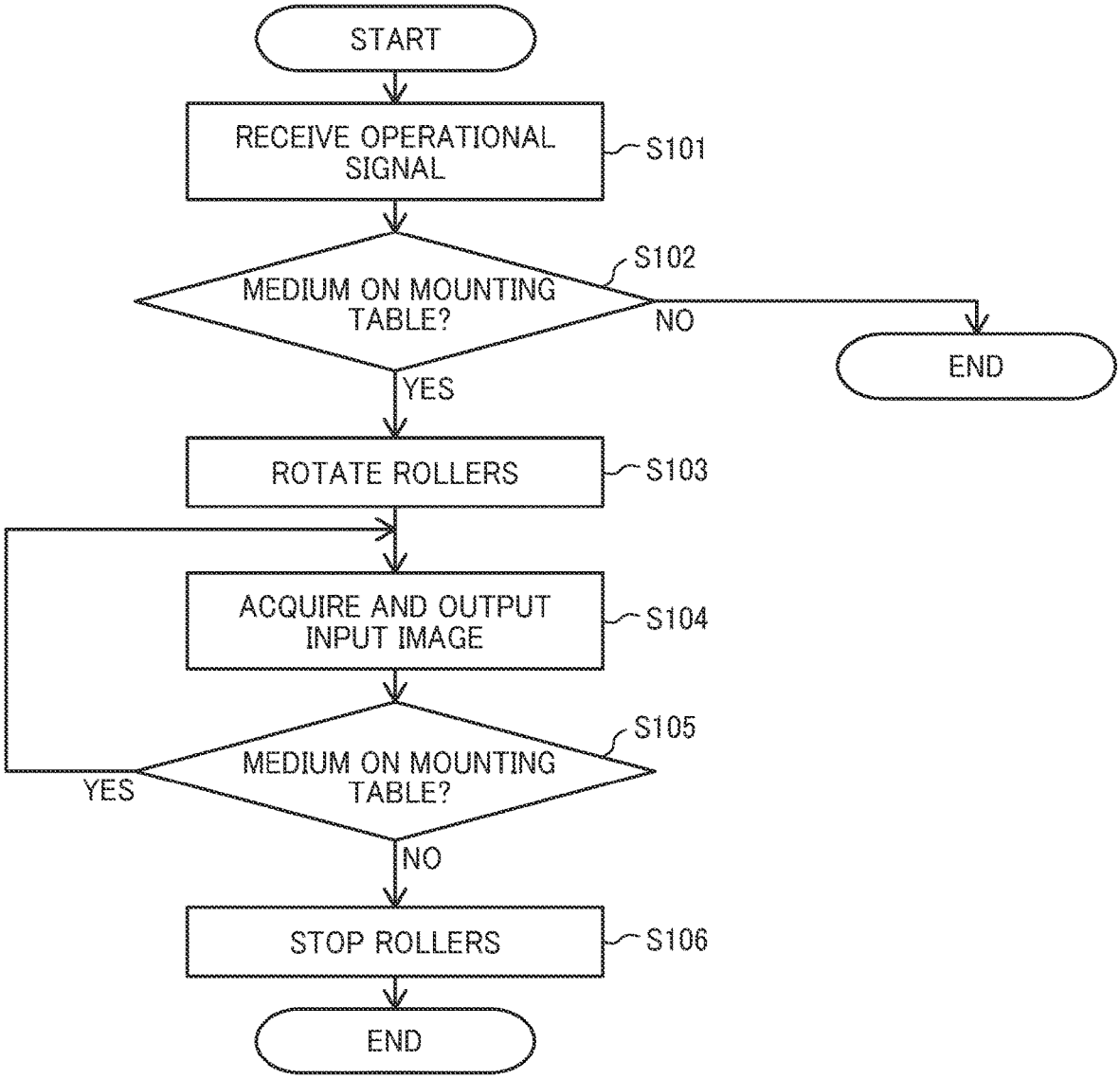
FIG. 13 is a flowchart of a medium scanning process according to an embodiment of the present disclosure.

FIG. 13 is a flowchart of the medium scanning process performed by the medium conveyance apparatus 100 according to the present embodiment.

The medium scanning process performed by the medium conveyance apparatus 100 according to the present embodiment is described below with reference to the flowchart of FIG. 13. The process described below is executed typically by the processing circuit 150 in cooperation with the multiple components of the medium conveyance apparatus 100 based on the programs stored in advance in the storage device 140.

In step S101, the control unit 151 waits until an instruction for scanning the medium is input through the operation device 105 or an information processing device and an operational signal providing instructions to scan the medium is received from the operation device 105 or the interface device 132.

In step S102, the control unit 151 obtains a medium signal from the medium sensor 121 and determines whether any medium is placed on the feed tray 103 based on the obtained medium signal. When no medium is placed on the feed tray 103, the control unit 151 terminates the series of steps.

By contrast, when a medium is placed on the feed tray 103, in step S103, the control unit 151 drives the motor 131 to lift the feed tray 103 to a position where the media can be fed, and drives the multiple rollers to rotate to feed and convey the media.

In step S104, the control unit 151 obtains an input image from the imaging device 127 by instructing the imaging device 127 to capture an image of the media, and transmits or outputs the obtained input image to an information processing device through the interface device 132.

In step S105, the control unit 151 determines whether any medium exists on the feed tray 103 based on the medium signal received from the medium sensor 121. When a medium exists on the feed tray 103, the control unit 151 returns the process to the processing in step S104 and repeats the processing in steps S104 to S105.

By contrast, when no medium exists in the feed tray 103, in step S106, the control unit 151 controls the motor 131 to stop each of the rollers, and ends the series of steps.

As described above in detail, when the feed tray 103 is accommodated in the first housing 101 of the medium conveyance apparatus 100 according to the present embodiment, the first contact portion 113 and the second contact portion 115 that are arranged on the feed tray 103 are brought into contact with the first to-be-contacted portion 114 and the second to-be-contacted portion 116 of the first housing 101. In the medium conveyance apparatus 100 according to the present embodiment, the movement of the feed tray 103 that could release the engagement of the engagement part 111 is restricted. Accordingly, in the medium conveyance apparatus 100 according to the present embodiment, the feed tray 103 can be maintained in the closed state as desired when the feed tray 103 provided to be openable and closable is closed.

Figure 14A:
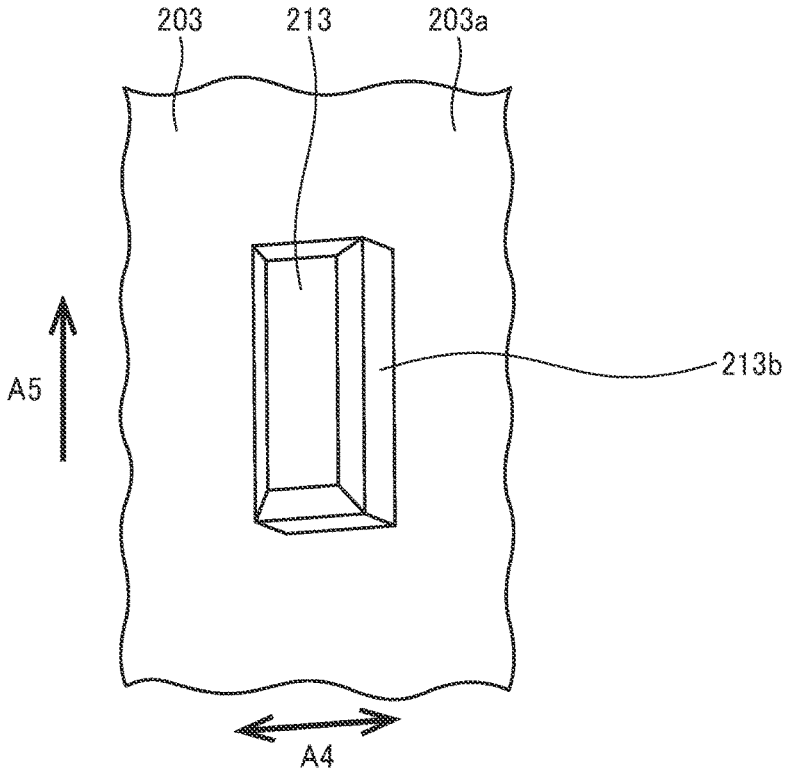
FIG. 14A and FIG. 14B are schematic diagrams illustrating a feed tray and a frame, according to an alternative embodiment of the present disclosure.
Figure 14B:
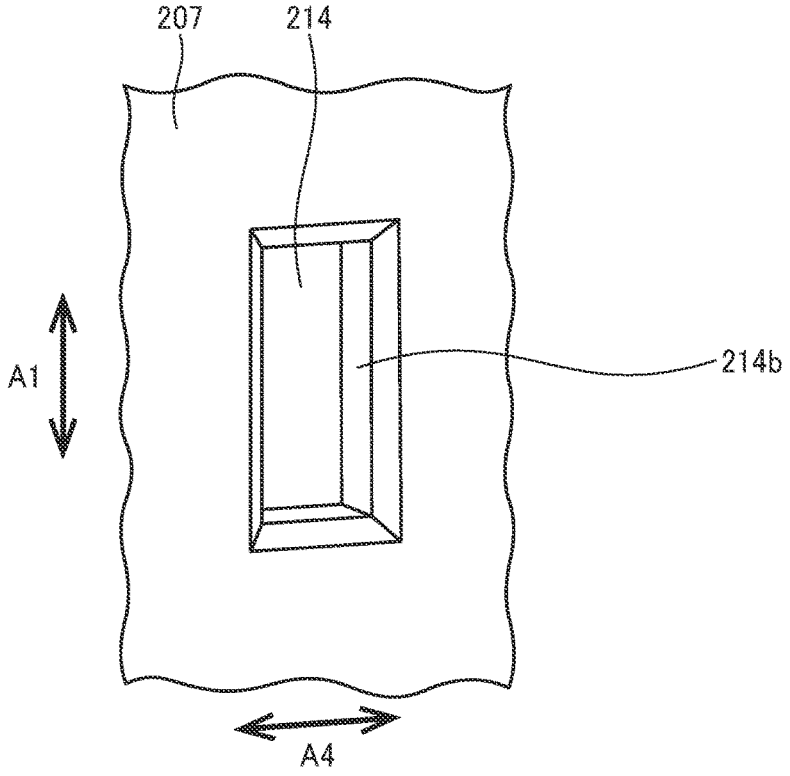

FIG. 14A and FIG. 14B are schematic diagrams of a feed tray 203 and a frame 207 of a medium conveyance apparatus according to still another alternative embodiment of the present disclosure.

The medium conveyance apparatus according to the present embodiment includes the elements of the medium conveyance apparatus 100. However, the medium conveyance apparatus according to the present embodiment includes a feed tray 203 and a frame 207 in place of the feed tray 103 and the frame 107. The feed tray 203 and the frame 207 have structures and functions similar to those of the feed tray 103 and the frame 107, respectively. The feed tray 203 is provided with a first contact portion 213 in place of the first contact portion 113, and the frame 207 is provided with a first to-be-contacted portion 214 in place of the first to-be-contacted portion 114.

The first contact portion 213 according to the present embodiment is an example of a contact portion. The first contact portion 213 is provided on the mounting table 203*a* to protrude upward when the feed tray 203 is in the opened state. In other words, the first contact portion 213 is provided to protrude in the medium conveyance direction A2 when the feed tray 203 is in the closed state. The first contact portion 213 is formed in an approximately rectangular parallelepiped shape, and has a contact surface 213*b* substantially orthogonal to the width direction A4. The contact surface 213*b* does not face the engagement part 111, whereas the other side of the first contact portion 213 in the width direction A4 faces the engagement part 111.

The first to-be-contacted portion 214 according to the present embodiment is an example of a to-be-contacted portion. The first to-be-contacted portion 214 is formed on a plane facing the mounting table 203*a* of the feed tray 203 in the closed state, and is bowed inward or recessed toward the medium conveyance direction A2. The first to-be-contacted portion 214 is formed in a substantially rectangular parallelepiped shape, and has a to-be-contacted surface 214*b* substantially orthogonal to the width direction A4. The to-be-contacted surface 214*b* does not face the to-be-engaged portion 112, whereas the other side of the first to-be-contacted portion 214 in the width direction A4 faces the to-be-engaged portion 112.

When the feed tray 203 is in the opened state, the first contact portion 213 is arranged at a position not facing the first to-be-contacted portion 214, and does not contact the first to-be-contacted portion 214. When the feed tray 203 is in the opened state, the first contact portion 213 and the first to-be-contacted portion 214 do not restrict the movement of the feed tray 203 in the width direction A4 with respect to the frame 207. By contrast, when the feed tray 203 is in the closed state, the first contact portion 213 is arranged inside the first to-be-contacted portion 214, and the contact surface

213*b* of the first contact portion 213 contacts the to-be-contacted surface 214*b* of the first to-be-contacted portion 214. When the feed tray 203 is in the closed state, the first contact portion 213 and the first to-be-contacted portion 214 restrict the movement of the feed tray 203 in the width direction A4, thereby restricting the separation of the engagement part 111 from the to-be-engaged portion 112.

Also in the present embodiment, the first contact portion 213 is arranged such that the distance between the first contact portion 213 and the hinge 108 becomes smaller than the distance between the engagement part 111 and the hinge 108.

As described above in detail, in the medium conveyance apparatus according to the above embodiments of the present disclosure, when the first contact portion 213 protrudes and the first to-be-contacted portion 214 is bowed inward or recessed, the feed tray 203 also can be maintained in the closed state as desired when the feed tray 203 provided to be openable and closable is in the closed state.

Figure 15A:
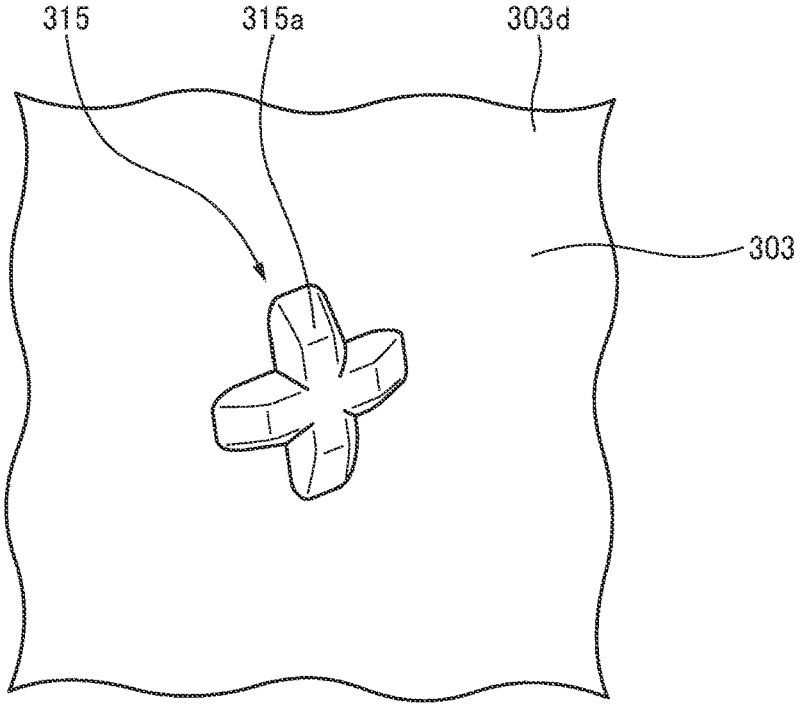
FIG. 15A is a schematic diagram illustrating a feed tray according to an alternative embodiment of the present disclosure.

FIG. 15A is a schematic diagram of a feed tray 303 of a medium conveyance apparatus according to still another alternative embodiment of the present disclosure.

The medium conveyance apparatus according to the present alternative embodiment includes the elements of the medium conveyance apparatus as described above, but the medium conveyance apparatus according to the present alternative embodiment is provided with the feed tray 303 instead of the feed tray 103 or the feed tray 203. The feed tray 303 has structures and functions similar to those of the feed tray 103 or the feed tray 203, but the second side surface 303*d* of the feed tray 303 is provided with a second contact portion 315 in place of the second contact portion 115. The second contact portion 315 according to the present embodiment is an example of a contact portion and has structures and functions similar to those of the second contact portion 115. The second contact portion 315 has a projecting part 315*a* formed to protrude from the second side surface 303*d* toward the outside in the width direction A4 (the side of the second inner side surface 107*b* of the frame 107). The projecting part 315*a* has a cross-like shape whose sides are inclined such that portions between the center of the cross and the multiple ends of the cross project the most.

As described above in detail, with the medium conveyance apparatus according to the present alternative embodiment where the second contact portion 315 is arranged, the feed tray 303 can be maintained in the closed state as desired when the feed tray 303 provided to be openable and closable is closed.

Figure 15B:
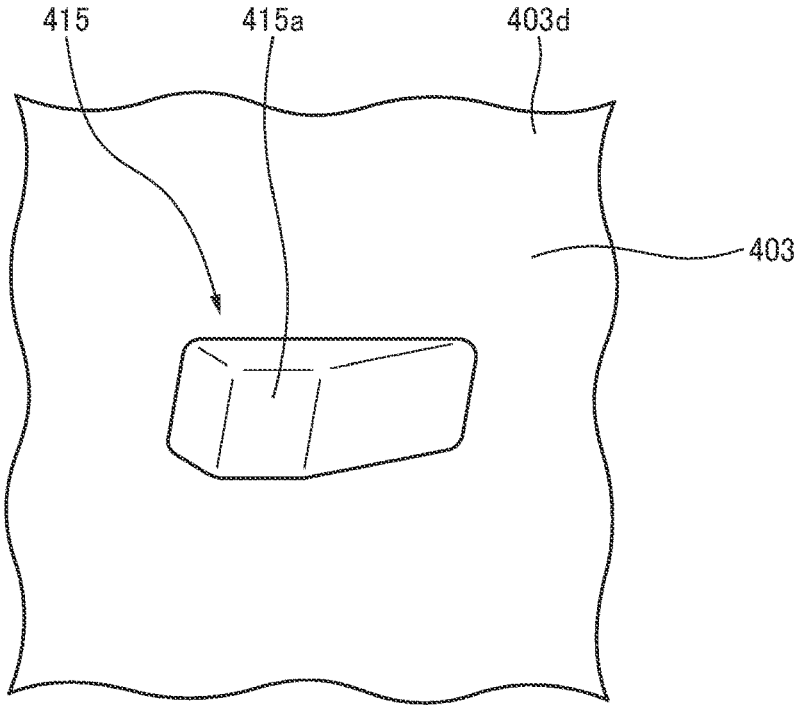
FIG. 15B is a schematic diagram illustrating a feed tray according to another alternative embodiment of the present disclosure.

FIG. 15B is a schematic diagram of a feed tray 403 of a medium conveyance apparatus according to still another alternative embodiment of the present disclosure.

In particular, the medium conveyance apparatus according to the present alternative embodiment includes the elements of the medium conveyance apparatus as described above, but the medium conveyance apparatus according to the present alternative embodiment is provided with the feed tray 403 instead of the feed tray 103 or the feed tray 203. The feed tray 403 according to the present alternative embodiment has structures and functions similar to those of the feed tray 103 or the feed tray 203, but the second side surface 403*d* of the feed tray 403 is provided with a second contact portion 415 in place of the second contact portion 115. The second contact portion 415 according to the present embodiment is an example of a contact portion and has structures and functions similar to those of the second contact portion 115. The second contact portion 415 has a projecting part 415*a* formed to protrude from the second side surface 403*d* toward the outside in the width direction A4 (the side of the second inner side surface 107*b* of the frame 107). The projecting part 415*a* has a hexahedron-like shape whose top surface and bottom surface have a substantially rectangular shape, and the top surface is smaller than the bottom surface. The projecting part 415*a* is inclined such that one side of the projecting part 415*a* (the side opposite a side contacting first with the second to-be-contacted portion 116 when the feed tray 103 in the opened state is closed) projects.

As described above in detail, in the medium conveyance apparatus according to the present alternative embodiment where the second contact portion 415 is provided, the feed tray 403 can be maintained in the closed state as desired when the feed tray 403 provided to be openable and closable is closed.

Figure 16:
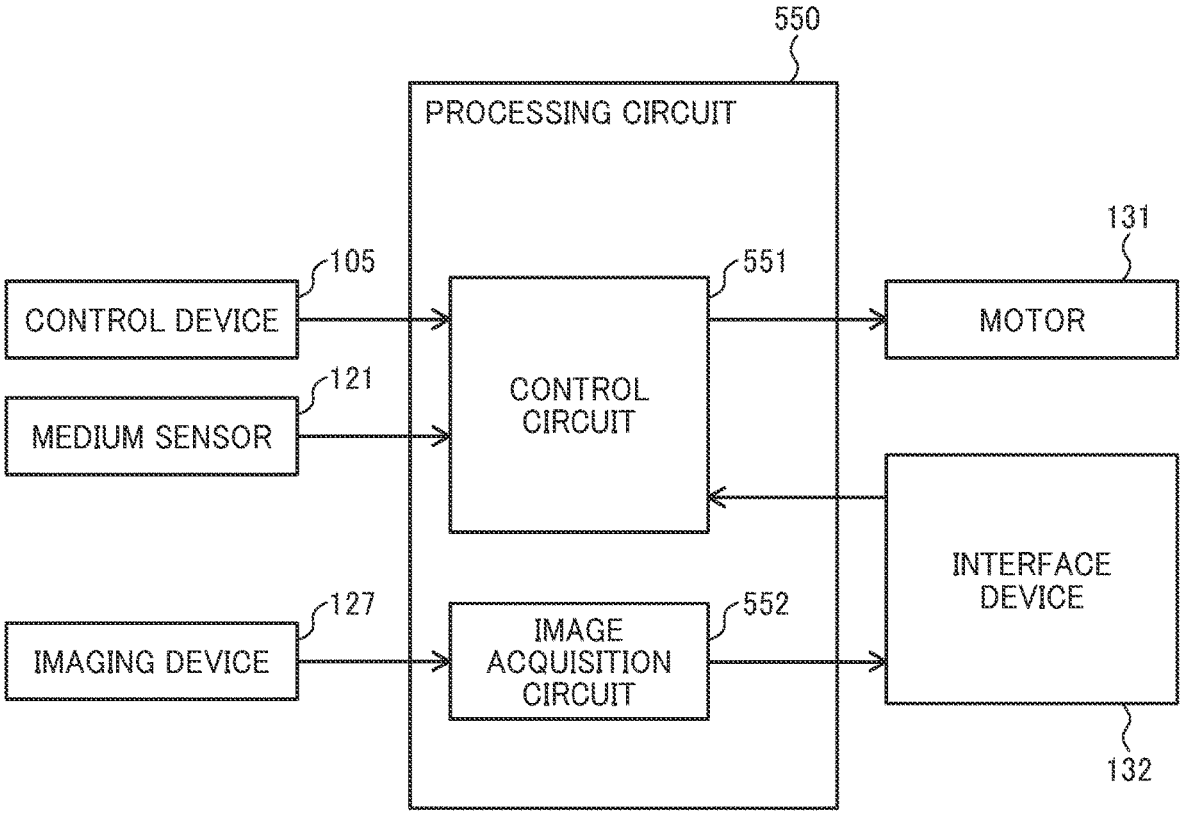
FIG. 16 is a diagram illustrating a schematic configuration of a processing circuit, according to an alternative embodiment of the present disclosure.

FIG. 16 is a diagram illustrating a schematic configuration of a processing circuit 550 of a medium conveyance apparatus according to an alternative embodiment of the present disclosure.

The processing circuit 550 according to the present alternative embodiment is used in place of the processing circuit 150 of the medium conveyance apparatus 100, and performs, for example, scanning process on media instead of the processing circuit 150. As illustrated in FIG. 16, the processing circuit 550 includes, for example, a control circuit 551 and an image acquisition circuit 552. These elements may be configured by, for example, independent integrated circuits, microprocessors, and firmware.

The control circuit 551 according to the present embodiment is an example of a control unit, and has functions similar to those of the control unit 151. The control circuit 551 receives an operational signal from the operation device 105 or the interface device 132, and receives a medium signal from the medium sensor 121. The control circuit 551 controls the motor 131 based on the received information.

The image acquisition circuit 552 according to the present embodiment is an example of an image acquisition unit, and has functions similar to those of the image acquisition unit 152. The image acquisition circuit 552 obtains an input image from the imaging device 127 and outputs the input image to the interface device 132.

As described above in detail, even when the processing circuit 550 is used in the medium conveyance apparatus according to the present alternative embodiment, the feed tray can be maintained in the closed state as desired when the feed tray provided to be openable and closable is closed.

In the above description, some preferred embodiments of the present disclosure are described. However, no limitation is intended by those embodiments of the present disclosure. For example, the engagement part 111 may be a recess or hole, and the to-be-engaged portion 112 may be a latch. One of the combination of the first contact portion and the first to-be-contacted portion and the combination of the second contact portion and the second to-be-contacted portion may be omitted. Instead of the second contact portion, the second to-be-contacted portion may have the projecting part. The frame may be arranged on the second housing 102 instead of the first housing 101. In such cases, the second housing 102 according to the present embodiment is an example of a housing. Also in such cases, in the medium conveyance apparatus according to the above embodiments of the present disclosure, when the feed tray provided to be openable and closable is closed, the feed tray can be maintained in the closed state as desired.

The engagement part, the first contact portion and/or the second contact portion may be arranged on the output tray instead of the feed tray. In such cases, the output tray according to the present embodiment is an example of the placing table. The output tray is provided to be openable and closable with respect to the second housing or the first housing, and a medium can be placed on the output tray when the output tray is in the opened state. The frame is arranged on the second housing or the first housing to face the output tray in the closed state. The to-be-engaged part, the first to-be-contacted portion, or the second to-be-contacted portion are arranged on the frame to face the engagement part, the first contact portion, and the second contact portion when the output tray is in the closed state. When the output tray is in the closed state, the engagement part engages with the to-be-engaged portion to maintain the output tray in the closed state as desired, the contact portion contacts the to-be-contacted portion and the movement of the output tray is restricted, thereby restricting separation of the engagement part from the to-be-engaged portion. In the medium conveyance apparatus according to the present alternative embodiment, the output tray can be maintained in the closed state as desired when the output tray provided to be openable and closable is closed.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application-specific integrated circuit (ASIC), digital signal processor (DSP), field-programmable gate array (FPGA), and conventional circuit components arranged to perform the recited functions.

What is claimed is:

1. A medium conveyance apparatus comprising:

a housing;

a placing table provided on the housing to be openable and closeable by rotating about a rotation axis and configured to place a medium when the placing table is in an opened state;

a to-be-engaged portion provided on the housing;

an engagement part provided on at least one side of the placing table to face the to-be-engaged portion when the placing table is in a closed state;

a to-be-contacted portion provided on the housing; and a contact portion provided on the placing table, wherein, when the placing table is in the closed state, the engagement part engages with the to-be-engaged portion and maintains the closed state of the placing table, and wherein, when the placing table is in the closed state, the contact portion contacts the to-be-contacted portion and restricts movement of the placing table in an extending direction of the rotation axis and thereby restricting separation of the engagement part from the to-be-engaged portion.

2. The medium conveyance apparatus according to claim 1, wherein the engagement part is provided on one side of the placing table.

3. The medium conveyance apparatus according to claim 1, wherein the contact portion has a hook-shaped portion with a contact surface inside, wherein the to-be-contacted portion has a hook-shaped portion with a to-be-contacted surface inside, and wherein, when the placing table is in the closed state, the contact surface contacts the to-be-contacted surface to restrict the movement of the placing table.

4. The medium conveyance apparatus according to claim 1, wherein the contact portion has a projecting part, and wherein, when the placing table is in the closed state, the projecting part contacts the to-be-contacted portion to restrict the movement of the placing table.

5. The medium conveyance apparatus according to claim 1, wherein the placing table is rotatably supported by the housing, and wherein a distance between the contact portion and the rotation axis of the placing table is smaller than a distance between the engagement part and the rotation axis.

6. The medium conveyance apparatus according to claim 1, wherein the to-be-engaged portion is recessed in the extending direction of the rotation axis, and wherein the engagement part protrudes in the extending direction of the rotation axis.

7. The medium conveyance apparatus according to claim 1, wherein the contact portion is provided on at least one end in the extending direction of the rotation axis on the placing table.

* * * * *